US006901771B2

(12) United States Patent
Ooide

(10) Patent No.: US 6,901,771 B2
(45) Date of Patent: Jun. 7, 2005

(54) JEWEL AND PERSONAL ORNAMENT

(75) Inventor: Ryosuke Ooide, Tokyo (JP)

(73) Assignee: Planet Co., Tokyo (JP)

( * ) Notice: Subject to any disclaimer, the term of this patent is extended or adjusted under 35 U.S.C. 154(b) by 0 days.

(21) Appl. No.: 10/078,667

(22) Filed: Feb. 21, 2002

(65) Prior Publication Data

US 2003/0154742 A1 Aug. 21, 2003

(51) Int. Cl.[7] ..... A44C 17/02
(52) U.S. Cl. ..... 63/26; 63/38
(58) Field of Search ..... 63/26, 38, 3, 3.2

(56) References Cited

U.S. PATENT DOCUMENTS

| | | | | | |
|---|---|---|---|---|---|
| 849,164 | A | * | 4/1907 | Roede | 63/38 |
| 1,043,063 | A | * | 11/1912 | Cahoone | 63/3.1 |
| 1,124,518 | A | * | 1/1915 | Qvarnstrom | 24/115 H |
| 3,347,037 | A | * | 10/1967 | Klang | 63/21 |
| 3,382,589 | A | * | 5/1968 | Dowling | 434/246 |
| 3,481,155 | A | * | 12/1969 | Cook | 63/3.2 |
| 3,905,525 | A | * | 9/1975 | Kawamata | 224/245 |
| 3,977,458 | A | * | 8/1976 | Kuen | 160/332 |
| 4,246,679 | A | | 1/1981 | Monett | |
| 4,321,804 | A | * | 3/1982 | Borofsky et al. | 63/3.2 |
| 4,800,738 | A | * | 1/1989 | Bunz | 63/26 |
| 5,007,252 | A | | 4/1991 | Mochizuki | |
| 5,123,645 | A | * | 6/1992 | MacDonald et al. | 473/594 |
| 5,138,855 | A | * | 8/1992 | Faris | 70/457 |
| 5,440,900 | A | * | 8/1995 | White | 63/38 |
| 5,491,986 | A | * | 2/1996 | White | 63/29.1 |
| 6,131,408 | A | | 10/2000 | Gill | |
| 6,499,314 | B1 | * | 12/2002 | Weinmann et al. | 63/26 |
| 2002/0148250 | A1 | * | 10/2002 | Pratt | |

FOREIGN PATENT DOCUMENTS

| | | | | |
|---|---|---|---|---|
| DE | 19840116 | A1 * | 3/1999 | A44C/13/00 |
| JP | 61-24087 | | 7/1986 | |
| JP | 06284919 | A * | 10/1994 | A44C/17/00 |
| JP | 3042071 | | 7/1997 | |
| JP | 10-137016 | | 5/1998 | |
| JP | 11-46826 | | 2/1999 | |
| JP | 2000-050921 | | 2/2000 | |
| JP | 2000-245516 | | 9/2000 | |
| JP | 2000-312608 | | 11/2000 | |
| JP | 2001-275726 | | 10/2001 | |

* cited by examiner

*Primary Examiner*—Jack W. Lavinder
(74) *Attorney, Agent, or Firm*—Oblon, Spivak, McClelland, Maier & Neustadt, P.C.

(57) ABSTRACT

It is an object of the present invention to provide a jewel which can be securely attached to a string-form member or pedestal with a stable frictional force, and which can be easily removed from such a string-form member or pedestal. The base body has a hole, and the hole opens at the surface of the base body. The elastic body has a through-hole, and is inserted into the interior of the hole. At least one open end of the through-hole communicates with the outside of the base body via the hole, and the internal diameter of the through-hole is gradually expanded toward the abovementioned open end.

15 Claims, 20 Drawing Sheets

JEWEL AND PERSONAL ORNAMENT

BACKGROUND OF THE INVENTION

1. Field of the Invention

The present invention relates to a jewel and a personal ornament using this jewel.

2. Description of the Related Art

Various types of accessories exceptionally using jewels such as pearls, tortoise shell, amber and precious stones or the like have been known in the past. Examples of accessories using pearls include pearl necklaces, pearl pendants, pearl finger rings, pearl necktie pins and pearl cufflinks or the like. It is recognized that the term "pearl" generally refers to a spherical substance consisting chiefly of calcium carbonate that is formed in the bodies of shellfish such as *Pteria penguin, Pinctada fucata* or *Pinctada maxima*. Besides pearls that have such a common spherical shape, pearl accessories that are worked into various shapes are also currently marketed.

In the case of necklaces, however, a plurality of pearls are disposed in the manner of a string of beads on a string-form member in a state that allows free movement of the pearls. As a result, the pearls rub against each other so that the pearls are susceptible to damage caused by such rubbing. If it were possible to attach pearls to a string-form member with an appropriate frictional force, such rubbing of the pearls against each other could be avoided, however, no such technique is known.

Furthermore, in the case of pendants, finger rings, necktie pins, cufflinks and the like, the attachment of pearls to pedestals is not easy. Moreover, in cases where pearls fall from such pedestals, repair is difficult for anyone other than a specialist.

The case of pearls was described in detail above; however, similar problems also occur in the case of other jewels such as tortoise shell, amber and precious stones.

SUMMARY OF THE INVENTION

It is an object of the present invention to provide a jewel which can be securely attached to a string-form member or pedestal with a stable frictional force, and which can be easily removed from such a string-form member or pedestal, and a personal ornament using such a jewel.

In order to achieve the abovementioned object, the jewel of the present invention comprises a base body and an elastic body. The abovementioned base body has a hole, and this hole opens at the surface of the abovementioned base body.

The abovementioned elastic body has a through-hole, and is inserted into the interior of the abovementioned hole. At least one open end of the abovementioned through-hole communicates with the outside of the abovementioned base body via the abovementioned hole. Furthermore, the internal diameter of the abovementioned through-hole is gradually expanded toward the abovementioned open end.

In the jewel of the present invention, as described above, the base body has a hole that opens at the surface of the base body, and an elastic body is inserted into the interior of this hole. This elastic body has a through-hole, and at least one open end of this through-hole communicates with the outside of the base body via the above-mentioned hole. Accordingly, a string-form member or projection can be inserted into the through-hole of the elastic body via the hole in the base body.

When a string-form member or projection is inserted into the through-hole of the elastic body, a frictional resistance is generated in the string-form member or projection utilizing the elastic force of the elastic body, so that the jewel can be securely attached.

Moreover, after the elastic body has been inserted into the interior of the hole in the base body, the string-form member or projection can be held not only by the elastic force of the elastic body, but also by the compressive force received by the elastic body from the inside surfaces of the hole in the base body. As a result, a high retention force is obtained.

The internal diameter of the through-hole in the elastic body is gradually expanded toward the abovementioned open end. Consequently, when a string-form member or projection is inserted into the through-hole of the elastic body, this string-form member or projection can be smoothly inserted from the abovementioned open end of the through-hole. Accordingly, the elastic body can be prevented from suffering damage caused by the force that is applied when the string-form member or projection is inserted.

In order to remove the jewel, it is sufficient merely to withdraw the string-form member or projection from the through-hole of the elastic body against the elastic retention force of the elastic body. Accordingly, the jewel can be removed very easily. In this case as well, since the internal diameter of the through-hole in the elastic body is gradually expanded toward the abovementioned open end, the elastic body can be prevented from suffering damage caused by the force that is applied when the string-form member or projection is withdrawn from the through-hole in the elastic body.

In cases where a plurality of jewels are attached to a string-form member in necklaces or the like, the string-form member is inserted into the through-hole of an elastic body provided for each jewel. Accordingly, a plurality of jewels can be attached to the string-form member with an appropriate frictional force, so that damage caused by the jewels rubbing against each other can be avoided.

Furthermore, in cases where jewels are attached to a pedestal in pendants, finger rings, necktie pins, cufflinks or the like, the jewels can be easily and securely attached to the pedestal by inserting a projection disposed on the pedestal into the through-hole of an elastic body provided for the jewel. Furthermore, the jewel can be removed from the pedestal and repaired or replaced.

Other objects, constructions and advantages of the present invention will be described in greater detail with reference to the attached figures, which indicate embodiments.

DESCRIPTION OF THE PREFERRED EMBODIMENTS

Figure 1:
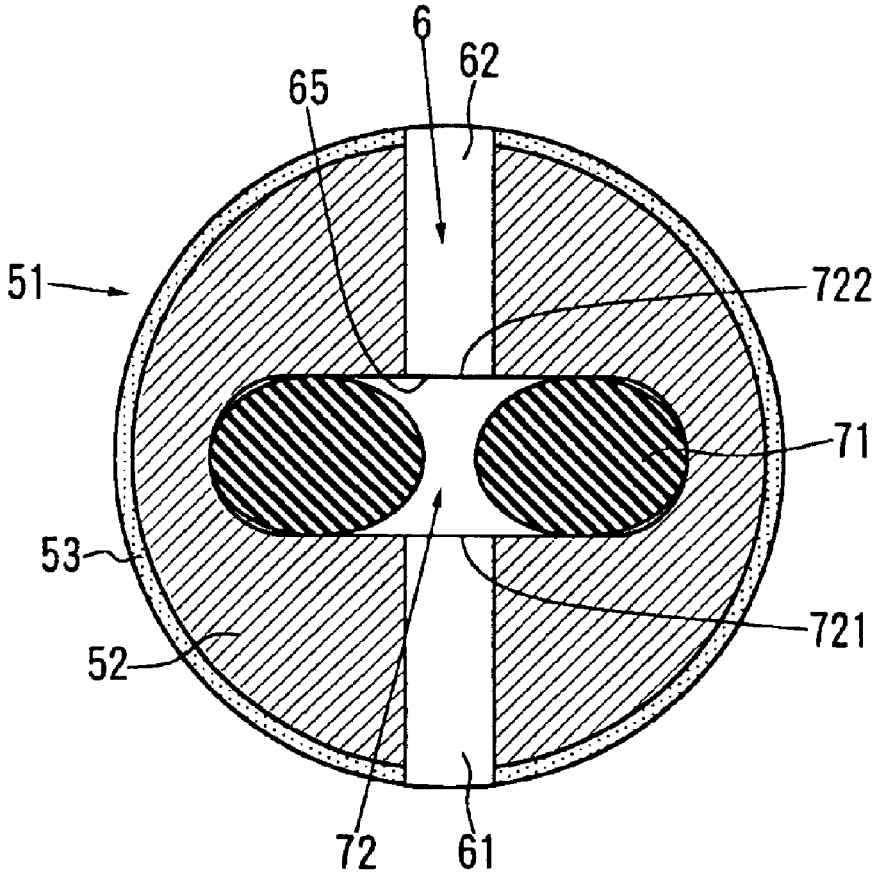
FIG. 1 is a sectional view of one embodiment of the jewel of the present invention.

FIG. 1 is a sectional view of one embodiment of the jewel of the present invention. As is shown in this figure, the jewel of the present invention comprises a base body 51 and an elastic body 71.

Figure 2:
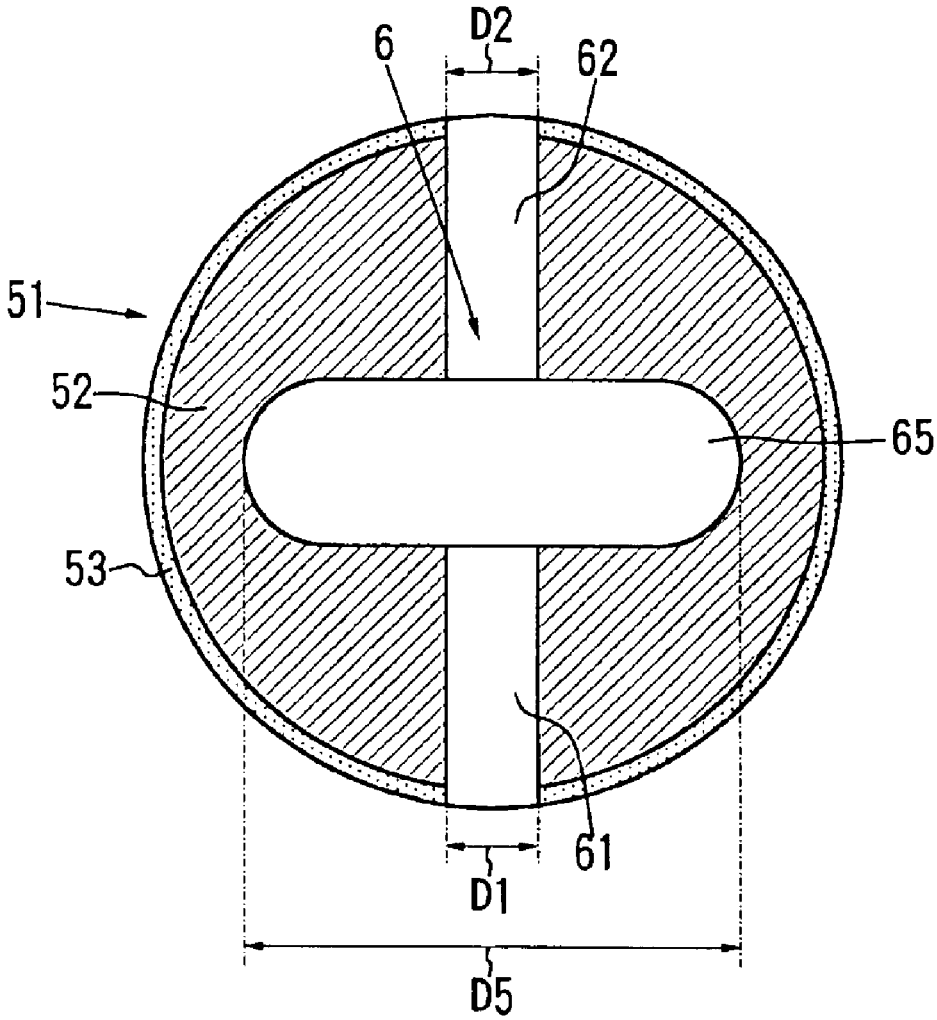
FIG. 2 is a sectional view of the base body contained in the jewel shown in FIG. 1.

FIG. 2 is a sectional view of the base body contained in the jewel shown in FIG. 1. As is shown in FIG. 2, the base body 51 has a hole 6. The shape of the base body 51 is arbitrary. In the embodiment, the base body 51 has a substantially spherical shape.

The base body 51 can be constructed from a pearl, tortoise shell, amber, precious stone or the like. The base body 51 in the embodiment is a pearl. The base body 51 consisting of a pearl comprises a matrix material 52 and a pearl layer 53. The abovementioned hole 6 passes through the pearl layer 53 and reaches the matrix material 52. The matrix material 52 consists of a shell such as *Pteria penguin, Pinctada fucata, Pinctada maxima* or the like. The matrix material 52 shown in the figure has a substantially spherical shape.

The pearl layer 53 is caused to adhere to the surface of the matrix material 52. In concrete terms, the pearl layer 53 is obtained by embedding the abovementioned shell as a nucleus in the body of one of the abovementioned shellfish, and forming a substance that consists chiefly of calcium carbonate that is generated inside the body of the shellfish on the surface of the abovementioned nucleus. The nucleus that is used forms the matrix material 52.

Next, the construction of the hole 6 in the base body 51 will be described. The hole 6 opens at the surface of the base body 51. In this embodiment, the hole 6 is a hole that passes entirely through the base body 51. The hole 6 shown in the figure has a structure that passes rectilinearly through the base body 51. The hole may also have a structure that passes through the base body so that the hole bends inside the base body, unlike the structure shown in the embodiment illustrated in the figure.

The hole 6 includes first hole parts 61 and 62, and a second hole part 65. The hole 6 shown in the figure has two first hole parts, i.e., first hole parts 61 and 62. The first hole parts 61 and 62 open at the surface of the base part 51. The internal diameters of the first hole parts 61 and 62 are respectively designated as D1 and D2. The first hole parts 61 and 62 shown in the figure have a substantially cylindrical shape, and one or the two bottom surfaces of the cylinders opens at the surface of the base body 51. The internal diameters D1 and D2 of the first hole parts 61 and 62 are the internal diameters of the cylinders that constitute the first hole parts 61 and 62. In the case of a base body 51 consisting of a pearl, the first hole parts 61 and 62 pass through the pearl layer 53 and reach the matrix material 52.

The second hole part 65 is disposed in the interior of the base body 51. The shape of the second hole part 65 substantially agrees with a flattened spherical shape that is obtained by crushing a spherical body between two plates that are parallel to each other. In the case of a base body 51 consisting of a pearl, the second hole part 65 is disposed in the matrix material 52.

Furthermore, the second hole part 65 communicates with the first hole parts 61 and 62. To describe this in greater detail, the second hole part 65 communicates with the other bottom surfaces of the two bottom surfaces of the cylinders that constitute the first hole parts 61 and 62.

Furthermore, the second hole part 65 has an internal diameter D5 that is larger than the internal diameters D1 and D2 of the first hole parts 61 and 62. The internal diameter D5 of the second hole part 65 is the maximum internal diameter of the abovementioned flattened spherical shape.

Next, the elastic body 71 will be described with reference to FIG. 1. The elastic body 71 has a through-hole 72, and is inserted into the interior of the hole 6 in the base body 51. The elastic body 71 is in a compressed state inside the hole 6 of the base body 51. The elastic body 71 can be constructed from an organic material, metal material or the like. The elastic body 71 shown in the figure is constructed from an organic material such as rubber, a silicone rubber or the like. Furthermore, the two open ends of the through-hole 72 are respectively indicated by the reference symbols 721 and 722.

At least one of the two open ends 721 and 722 of the through-hole 72 in the elastic body 71, i.e., the open end 721, communicates with the outside of the base body 51 via the hole 6 in the base body 51. In the embodiment, the hole 6 in the base body 51 is a through-hole as was described above, and the through-hole 72 in the elastic body 71 is also constructed in accordance with such a construction of the hole 6. In concrete terms, the two open ends 721 and 722 of the through-hole 72 respectively communicate with the outside of the base body 51 via the hole 6.

The internal diameter of the through-hole 72 in the elastic body 71 is gradually expanded toward the abovementioned open end 721. In the embodiment, the internal diameter of the through-hole 72 is gradually expanded toward each of the two open ends 721 and 722. As an example of an elastic body 71 that has such a shape, the elastic body 71 shown in the figure is constructed from an O-ring. In particular, an O-ring constructed from rubber, a silicone rubber or the like is especially suitable. The through-hole in the elastic body may also have a construction in which the internal diameter is expanded toward only one of the open ends, unlike the construction of the embodiment shown in the figure.

The elastic body 71 of the embodiment shown in the figure is disposed in the interior of the abovementioned second hole part 65. One open end 721 of the through-hole 72 in the elastic body 71 communicates with the outside of the base body 51 via the first hole part 61, and the other open end 722 communicates with the outside of the base body 51 via the first hole part 62. The elastic body 71 is disposed in the interior of the second hole part 65 so that one open end 721 of the through-hole 72 and the first hole part 61 face each other, and so that the other open end 722 of the through-hole 72 and the first hole part 62 face each other.

Figure 3:
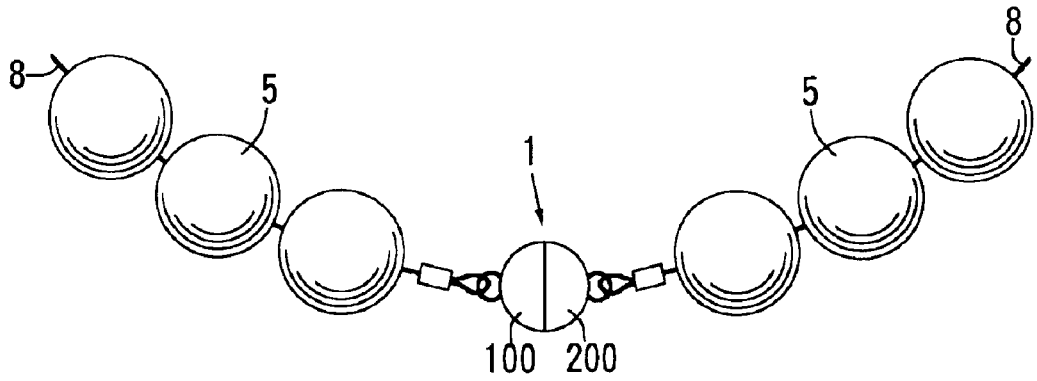
FIG. 3 is a perspective view of one embodiment of a personal ornament using the jewel shown in FIG. 1.

FIG. 3 is a perspective view of one embodiment of a personal ornament using the jewel shown in FIG. 1. The personal ornament shown in FIG. 3 comprises jewels 5 and a joining member 8. The personal ornament shown in the figure is a necklace. Besides a necklace, the personal ornament may also be a bracelet, anklet or the like. The jewels 5 are jewels of the present invention as shown in FIG. 1.

Figure 4:
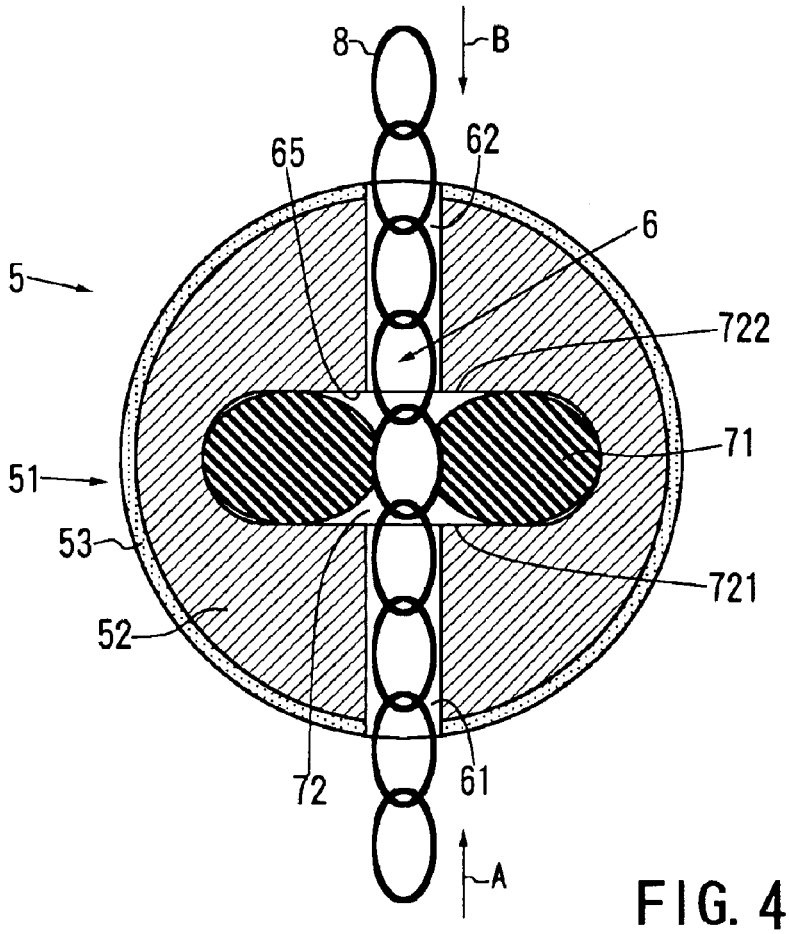
FIG. 4 is a sectional view of the jewel contained in the personal ornament shown in FIG. 3.

FIG. 4 is a sectional view of one of the jewels contained in the personal ornament shown in FIG. 3. As is shown in FIG. 4, the joining member 8 is inserted into the through-hole 72 of the elastic body 71 contained in the jewel 5, and is elastically held in this through-hole 72. The joining member 8 passes through the hole 6 in the base body 51 from the outside of the base body 51, and passes through the through-hole 72 of the elastic body 71 that is inserted into the interior of the hole 6. Furthermore, the joining member 8 passes through the hole 6 in the base body 51, and is led to the outside of the base body 51.

As was described above, the hole 6 shown in the figure comprises first hole parts 61 and 62 and a second hole part 65. The joining member 8 passes through the first hole part 61 of the hole 6 from the outside of the base body 51, and passes through the through-hole 72 in the elastic body 71 that is disposed in the interior of the second hole part 65. The joining member 8 further passes through the first hole part 62, and is led to the outside of the base body 51.

As is shown in FIGS. 3 and 4, the joining member 8 is a string-form member. The string-form joining member 8 may be constructed from a chain, metal wire, fiber or combination of these. The string-form joining member 8 will be referred to below as the "string-form member 8". A plurality of jewels 5 are used. The string-form member 8 is passed through the plurality of jewels 5, so that the plurality of jewels 5 are disposed on the string-form member 8 in the form of a string of beads.

Referring to FIG. 3, a fastening fitting 1 is used to join the personal ornament. This fastening fitting 1 comprises a first fastening member 100 and a second fastening member 200. The first fastening member 100 is connected to one end portion of the string-form member 8, and the second fastening member 200 is connected to the other end portion of the string-form member 8. The first fastening member 100 and second fastening member 200 are detachably connected to each other.

The jewels 5 are jewels of the present invention as shown in FIG. 1. In each jewel 5, the base body 51 has a hole 6 that opens at the surface of the base body 51, and an elastic body 71 is inserted into the interior of this hole 6. This elastic body 71 has a through-hole 72, and at least one open end 721 of this through-hole 72 communicates with the outside of the base body 51 via the hole 6. Accordingly, as is shown in FIG. 4, the string-form member 8 can be inserted into the through-hole 72 of the elastic body 71 via the hole 6 in the base body 51. More specifically, the string-form member 8 can be inserted into the through-hole 72 from the side of the abovementioned open end 721 (see arrow A).

As is shown in FIG. 4, when the string-form member 8 is inserted into the through-hole 72 of the elastic body 71, a frictional resistance is generated in the string-form member 8 utilizing the elastic force of the elastic body 71, so that the jewel 5 can be securely attached.

Moreover, after the elastic body 71 has been inserted into the interior of the hole 6 in the base body 51, the string-form member 8 can be held not only by the elastic force of the elastic body 71, but also by the compressive force received by the elastic body 71 from the inside surfaces of the hole 6 in the base body 51. Accordingly, a high retention force is obtained.

The internal diameter of the through-hole 72 in the elastic body 71 is gradually expanded toward the abovementioned open end 721. Accordingly, when the string-form member 8 is inserted into the through-hole 72 of the elastic body 71, this string-form member 8 can be smoothly inserted from the solid-state imaging device of the abovementioned open end 721 of the through-hole 72 (see arrow A). Consequently, the elastic body 71 can be prevented from suffering damage caused by the force that is applied when the string-form member 8 is inserted.

In order to remove the jewels 5, it is sufficient to withdraw the string-form member 8 from the through-hole 72 of the corresponding elastic body 71 against the elastic retention force of the elastic body 71. Accordingly, the jewels 5 can be removed very easily. In this case as well, since the internal diameter of the through-hole 72 in the elastic body 71 is gradually expanded toward the abovementioned open end 721, the elastic body 71 can be prevented from suffering damage caused by the force that is applied when the string-form member 8 is withdrawn from the through-hole 72 of the elastic body 71.

In the jewel 5 of the embodiment, the hole 6 is a hole that passes entirely through the base body 51. Furthermore, each of the two open ends 721 and 722 of the through-hole 72 in the elastic body 71 communicates with the outside of the base body 51 via the abovementioned hole 6. Accordingly, as is shown in FIG. 4, the string-form member 8 can be passed through the hole 6 of the base body 51 and the through-hole 72 of the elastic body 71.

When the string-form member 8 is passed through as described above, the jewel 5 can be attached to the string-form member 8 with an appropriate frictional force. Accordingly, if a plurality of jewels 5 of the embodiment are prepared, and the same string-form member 8 is passed through the respective jewels 5, the plurality of jewels 5 can be attached to the string-form member 8 with an appropriate frictional force as shown in FIG. 3. As a result, damage caused by the jewels 5 rubbing against each other can be avoided.

In a pearl necklace constructed according to a conventional technique, a plurality of pearls are simply disposed on a string-form member in the manner of a string of beads, in a state in which the pearls can freely move. As a result, the pearls rub against each other, so that the pearl layers of the pearls are susceptible to damage caused by this rubbing.

In the present invention, on the other hand, a plurality of jewels 5 can be attached to a string-form member 8 with an appropriate frictional force. Accordingly, if the base bodies 51 of the jewels 5 are constructed by pearls, damage to the pearl layers 53 caused by the pearls rubbing together can be avoided.

The following description refers again to FIG. 4. In the embodiment, the internal diameter of the through-hole 72 in the elastic body 71 is gradually expanded toward each of the two open ends 721 and 722. Accordingly, when the string-form member 8 is passed through the through-hole 72 in the elastic body 71, damage to the elastic body 71 can be securely prevented. Moreover, damage to the elastic body 71 can also be securely prevented when the string-form member 8 that has been passed through is withdrawn from the through-hole 72 of the elastic body 71.

In the jewel 5 of the embodiment, the elastic body 71 is constructed from an organic material. Since this type of elastic body 71 is superior in terms of compressibility, the compressive force received from the inside surfaces of the hole 6 in the base body 51 is stabilized, so that the string-form member 8 can be stably held.

Furthermore, in a case where the elastic body 71 is an O-ring as shown in the figure, the elastic body 71 can be inserted into the interior of the hole 6 in the base body 51 by catching the elastic body 71 with catching means using a wire or the like. Accordingly, the elastic body 71 can easily be inserted into the interior of the hole 6.

In the jewel 5 shown in the figure, the hole 6 comprises first hole parts 61 and 62 and a second hole part 65. The first hole parts 61 and 62 open at the surface of the base body 51. The second hole part 65 is disposed in the interior of the base body 51, and communicates with the first hole parts 61 and 62. The elastic body 71 is disposed in the interior of the second hole part 65. By using such a structure, it is possible to protect the elastic body 71 in the interior of the base body 51 without losing the abovementioned function of the elastic body 71.

Furthermore, the second hole part 65 has an internal diameter D5 that is larger than the internal diameters D1 and D2 of the first hole parts 61 and 62. In other words, the diameters D1 and D2 of the first hole parts 61 and 62 are smaller than the diameter D5 of the second hole part 65. Such a structure is suitable for holding the elastic body 71 in the interior of the second hole part 65.

Figure 5:
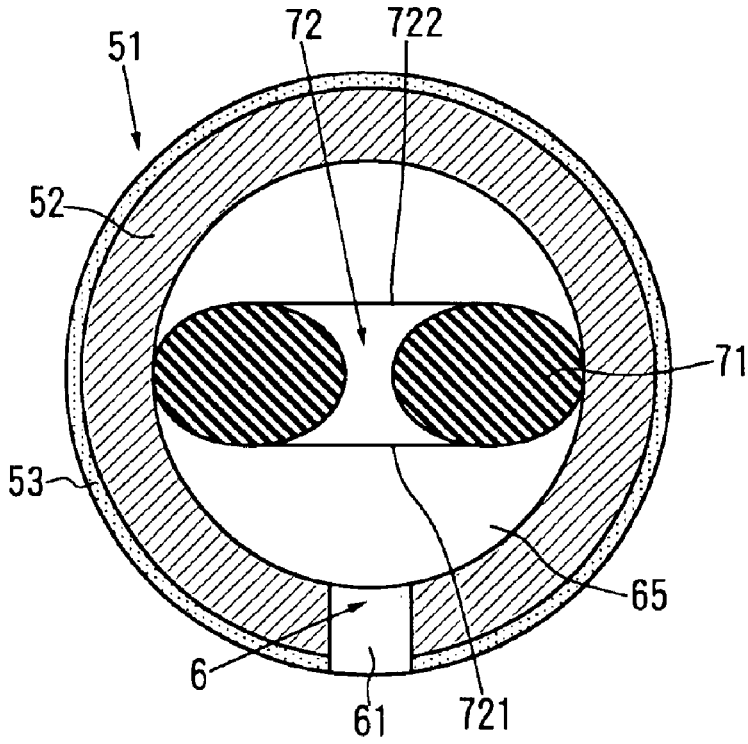
FIG. 5 is a sectional view of another embodiment of the jewel of the present invention.

FIG. 5 is a sectional view of another embodiment of the jewel of the present invention. In this figure, the same reference symbols are attached to constituent parts that are the same as constituent parts shown in FIG. 1. The jewel of this embodiment also comprises a base body 51 and an elastic body 71.

Figure 6:
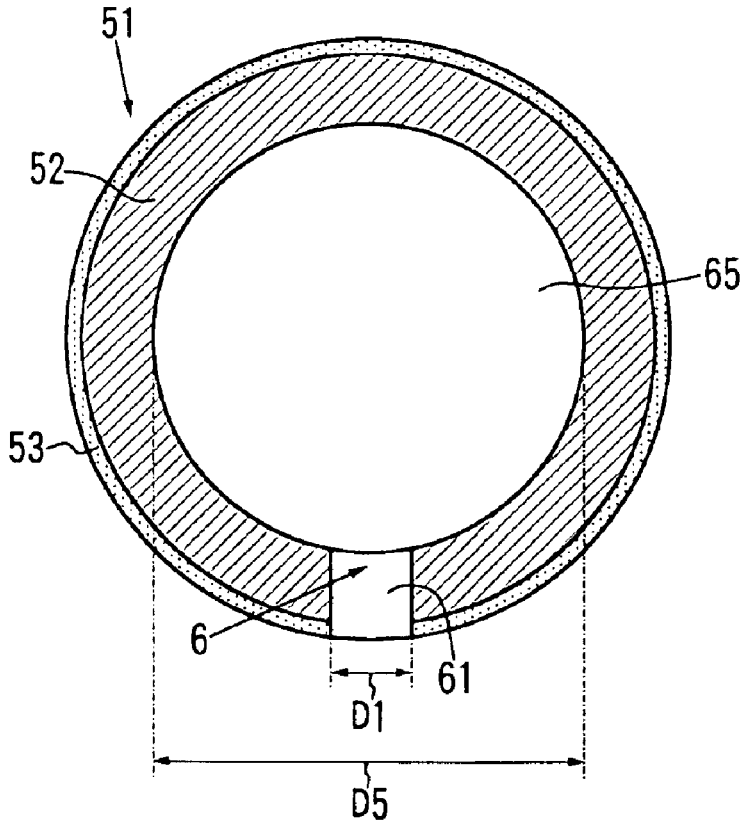
FIG. 6 is a sectional view of the base body contained in the jewel shown in FIG. 5.

FIG. 6 is a sectional view of the base body contained in the jewel shown in FIG. 5. As is shown in FIG. 6, this base body 51 has a hole 6. The base body 51 of this embodiment has the same construction as the base body 51 of the jewel shown in FIG. 1; accordingly, a detailed description is omitted. The base body 51 of this embodiment is also a pearl.

Next, the construction of the hole 6 in the base body 51 will be described. The hole 6 opens at the surface of the base body 51. However, unlike the hole 6 shown in the embodiment illustrated in FIG. 1, the hole 6 in this case is not a hole that passes entirely through the base body 51.

The hole 6 comprises a first hole part 61 and a second hole part 65. Unlike the hole 6 in the embodiment shown in FIG. 1, the hole 6 shown in the figure has only one first hole part 61. The first hole part 61 shown in the figure has a substantially cylindrical shape, and one of the two bottom surfaces of this cylinder opens at the surface of the base body 51. The internal diameter D1 of the first hole part 61 is the internal diameter of the cylinder that constitutes the first hole part 61.

The second hole part 65 is disposed in the interior of the base body 51, and communicates with the first hole part 61. The second hole part 65 has a substantially spherical shape. The second hole part 65 communicates with the other bottom surface of the two bottom surfaces of the cylinder that constitutes the first hole part 61.

Furthermore, the second hole part 65 has an internal diameter D5 that is larger than the internal diameter D1 of the first hole part 61. The internal diameter D5 of the second hole part 65 is the maximum internal diameter of the abovementioned spherical shape.

Next, the elastic body 71 will be described with reference to FIG. 5. The elastic body 71 has a through-hole 72, and is inserted into the interior of the hole 6 in the base body 51. The elastic body 71 is in a compressed state inside the hole 6 of the base body 51. The elastic body 71 is constructed from an organic material, metal material or the like. The elastic body 71 shown in the figure is constructed from an organic material such as rubber, a silicone rubber or the like.

At least one open end 721 of the two open ends 721 and 722 of the through-hole 72 in the elastic body 71 communicates with the outside of the base body 51 via the hole 6 in the base body 51. The through-hole 72 in this embodiment differs from that in the embodiment shown in FIG. 1 in that only one open end 721 communicates with the outside of the base body 51 via the hole 6.

The internal diameter of the through-hole 72 in the elastic body 71 is gradually expanded toward the abovementioned open end 721. In the embodiment, the internal diameter of the through-hole 72 is gradually expanded toward each of the two open ends 721 and 722. As an example of an elastic body 71 that has such a shape, the elastic body 71 shown in the figure is constructed from an O-ring. In particular, an O-ring constructed from rubber, a silicone rubber or the like is especially suitable. A construction in which the internal diameter of the through-hole in the elastic body is expanded toward only one of the open ends (unlike the embodiment shown in the figure) may also be used.

The elastic body 71 of the embodiment shown in the figure is disposed in the interior of the abovementioned second hole part 65. One open end 721 of the through-hole 72 of the elastic body 71 communicates with the outside of the base body 51 via the second hole part 65 and first hole part 61. The elastic body 71 is disposed in the interior of the second hole part 65 so that one open end 721 of the through-hole 72 and the first hole part 61 face each other.

Figure 7:
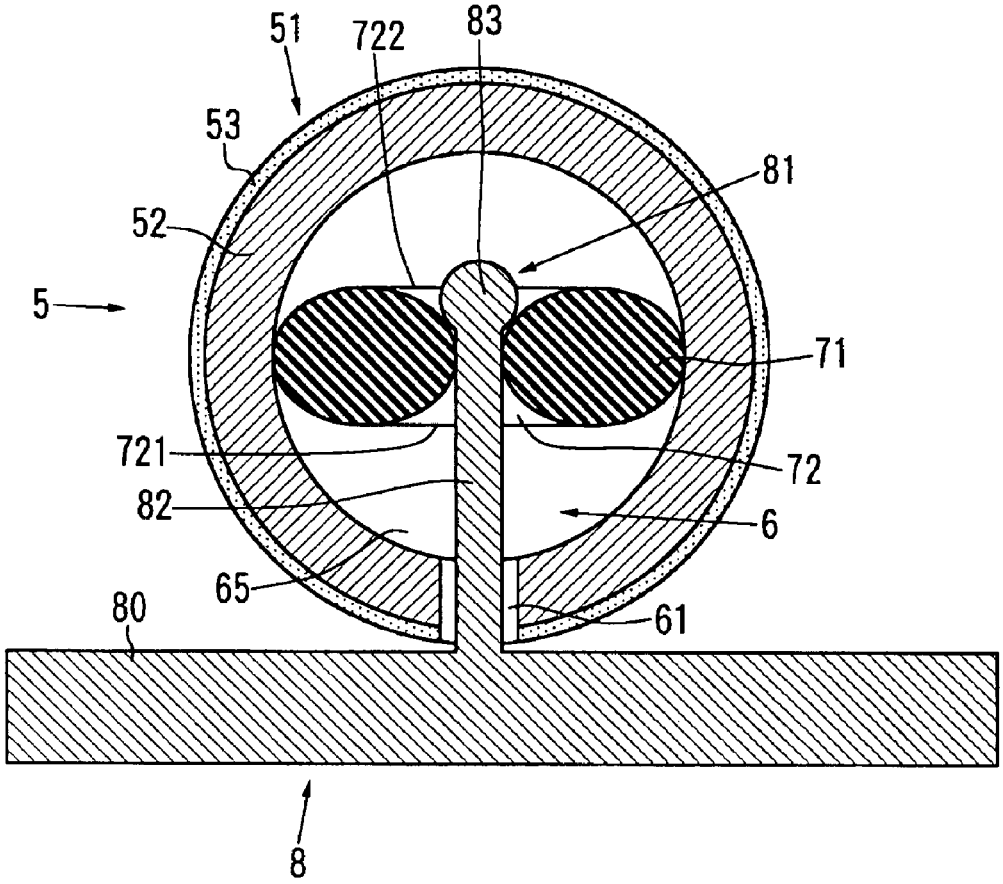
FIG. 7 is a sectional view of one embodiment of a personal ornament using the jewel shown in FIG. 5.

FIG. 7 is a sectional view of one embodiment of a personal ornament using the jewel shown in FIG. 5. The personal ornament shown in FIG. 3 comprises a jewel 5 and a joining member 8. The jewel 5 is the jewel of the present invention shown in FIG. 1.

The joining member 8 is inserted into the through-hole 72 of the elastic body 71 contained in the jewel 5. The joining member 8 comprises a pedestal 80 and a projection 81. The pedestal 80 is the pedestal of a pendant, finger ring, necktie pin, cufflink or the like. The projection 81 is disposed on the pedestal 80. The projection 81 is inserted into the through-hole 72 of the elastic body 71.

The projection 81 comprises a neck part 82 and an expanded part 83. One end of the neck part 82 is fastened to the pedestal 80. The neck part 82 has a circular cross-sectional shape. The expanded part 83 has a diameter that is larger than the diameter of the neck part 82, and is disposed on the other end of the neck part 82. The expanded part 83 has a substantially spherical shape.

The jewel 5 is the jewel of the present invention shown in FIG. 5. In the jewel 5, the base body 51 has a hole 6 that opens at the surface of the base body 51, and the elastic body 71 is inserted into the interior of the hole 6. This elastic body 71 has a through-hole 72, and at least one open end 721 of the through-hole 72 communicates with the outside of the base body 51 via the hole 6. Accordingly, as is shown in FIG. 7, the projection 81 can be inserted into the through-hole 72 of the elastic body 71 via the hole 6 of the base body 51.

As is shown in FIG. 7, when the projection 81 is inserted into the through-hole 72 of the elastic body 71, a frictional resistance is generated in the projection 81 utilizing the elastic force of the elastic body 71, so that the jewel 5 can be securely attached.

Furthermore, after the elastic body 71 has been inserted into the interior of the hole 6 of the base body 51, the projection 81 can be held not only by the elastic force of the elastic body 71, but also by the compressive force received by the elastic body 71 from the inside surfaces of the hole 6 in the base body 51. Accordingly, a high retention force is obtained.

The internal diameter of the through-hole 72 in the elastic body 71 is gradually expanded toward the abovementioned open end 721. Accordingly, when the projection 81 is inserted into the through-hole 72 of the elastic body 71, the projection 81 can be smoothly inserted from the side of the abovementioned open end 721 of the through-hole 72; consequently, the elastic body 71 can be prevented from receiving damage caused by the force that is applied when the projection 81 is inserted.

In order to remove the jewel 5, it is necessary merely to withdraw the projection 81 from the through-hole 72 of the elastic body 71 against the elastic retention force of the elastic body 71. Accordingly, the jewel 5 can be very easily removed. In this case as well, since the internal diameter of the through-hole 72 in the elastic body 71 is gradually expanded toward the abovementioned open end 721, the elastic body 71 can be prevented from suffering damage caused by the force that is applied when the projection 81 is withdrawn from the through-hole 72 of the elastic body 71.

In the embodiment, the internal diameter of the through-hole 72 in the elastic body 71 is gradually expanded toward each of the two open ends 721 and 722. Accordingly, when the projection 81 is passed through the through-hole 72 of the elastic body 71, damage to the elastic body 71 can be securely prevented. Furthermore, damage to the elastic body 71 can also be securely prevented when the projection 81 that has been passed through is withdrawn from the through-hole 72 of the elastic body 71.

In the jewel 5 of the embodiment, the elastic body 71 is constructed from an organic material. Since this type of elastic body 71 is superior in terms of compressibility, the compressive force received from the inside surfaces of the hole 6 in the base body 51 is stabilized, so that the joining member 8 can be stably held.

Furthermore, in a case where the elastic body 71 is an O-ring as shown in the figure, the elastic body 71 can be inserted into the interior of the hole 6 in the base body 51 by catching the elastic body 71 with catching means using a wire or the like. Accordingly, the elastic body 71 can easily be inserted into the interior of the hole 6.

In the jewel 5 shown in the figure, the hole 6 comprises a first hole part 61 and a second hole part 65. The first hole part 61 opens at the surface of the base body 51. The second hole part 65 is disposed in the interior of the base body 51, and communicates with the first hole part 61. The elastic body 71 is disposed in the interior of the second hole part 65. By using such a structure, it is possible to protect the elastic body 71 in the interior of the base body 51 without losing the above-mentioned function of the elastic body 71.

Furthermore, the second hole part 65 has an internal diameter D5 that is larger than the internal diameter D1 of the first hole part 61. In other words, the diameter D1 of the first hole part 61 is smaller than the diameter D5 of the second hole part 65. Such a structure is suitable for holding the elastic body 71 in the interior of the second hole part 65.

In cases where the jewel 5 is attached to the pedestal 80 in a pendant, finger ring, necktie pin, cufflink or the like, the jewel 5 can be easily and securely attached to the pedestal 80 by inserting the projection 81 disposed on the pedestal 80 into the through-hole 72 of the elastic body 71 installed in the jewel 5. Furthermore, the jewel 5 can be removed from the pedestal 80, and can be repaired or replaced.

When the jewel 5 is pushed toward the pedestal 80, or the pedestal 80 is pushed toward the jewel 5, a pressing force is applied to the elastic body 71 from the expanded part 83 of the projection 81. The internal diameter of the through-hole 72 in the elastic body 71 is gradually increased by this pressing force.

When the jewel 5 is pushed further toward the pedestal 80, or the pedestal 80 is pushed further toward the jewel 5, a further pressing force is applied to the elastic body 71 from the expanded part 83 of the projection 81. As a result of this pressing force, the internal diameter of the through-hole 72 in the elastic body 71 becomes even larger. Then, when the internal diameter of the through-hole 72 in the elastic body reaches the size of the diameter of the expanded part 83, the expanded part 83 passes through the through-hole 72; afterward, the internal diameter of the through-hole 72 returns to the initial dimension, so that the elastic body 71 surrounds the neck part 82.

On the basis of the elasticity of the abovementioned elastic body 71, the jewel 5 is securely held on the pedestal 80.

When the jewel 5 is pulled so that the jewel 5 is separated from the pedestal 80, or the pedestal 80 is pulled so that the pedestal 80 is separated from the jewel 5, a force is applied to the elastic body 71 from the expanded part 83 of the projection 81. The internal diameter of the through-hole 72 in the elastic body 72 is gradually increased by this force. Then, when the internal diameter of the through-hole 72 in the elastic body 71 reaches the size of the diameter of the expanded part 83, the expanded part 83 is pulled out of the elastic body 71. As a result, the jewel 5 is removed from the pedestal 80.

Figure 8:
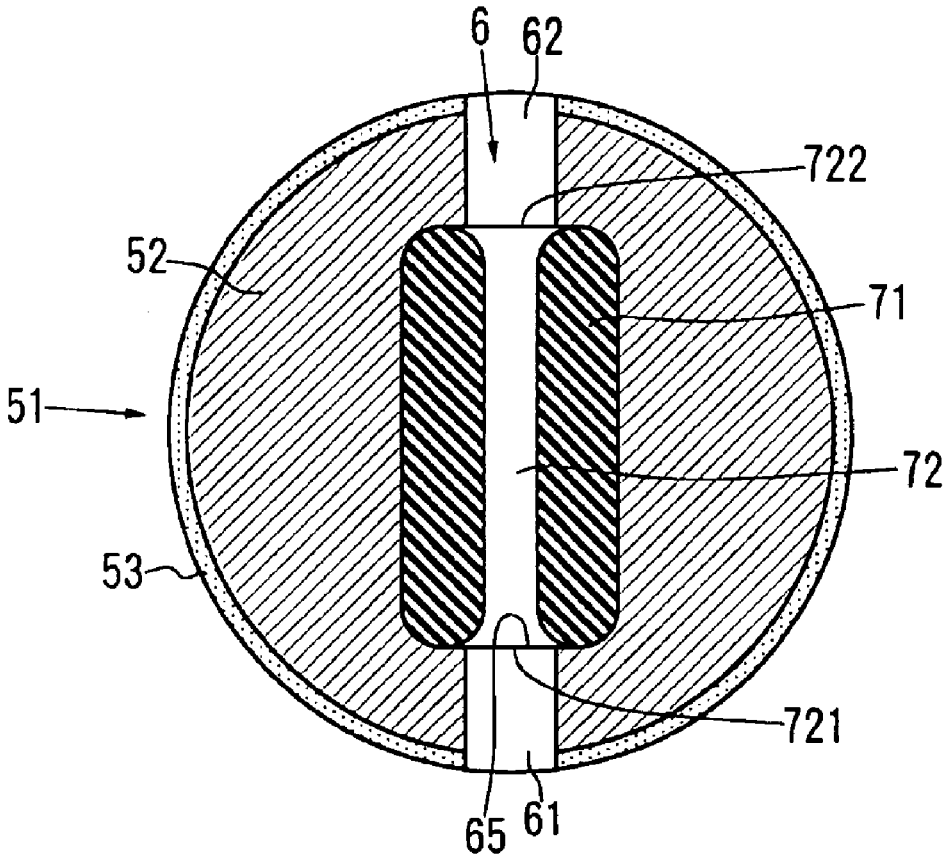
FIG. 8 is a sectional view of still another embodiment of the jewel of the present invention.

FIG. 8 is a sectional view of still another embodiment of the jewel of the present invention. In this figure, the same reference symbols are attached to constituent parts that are the same as constituent parts shown in FIG. 1. The jewel of this embodiment also comprises a base body 51 and an elastic body 71.

Figure 9:
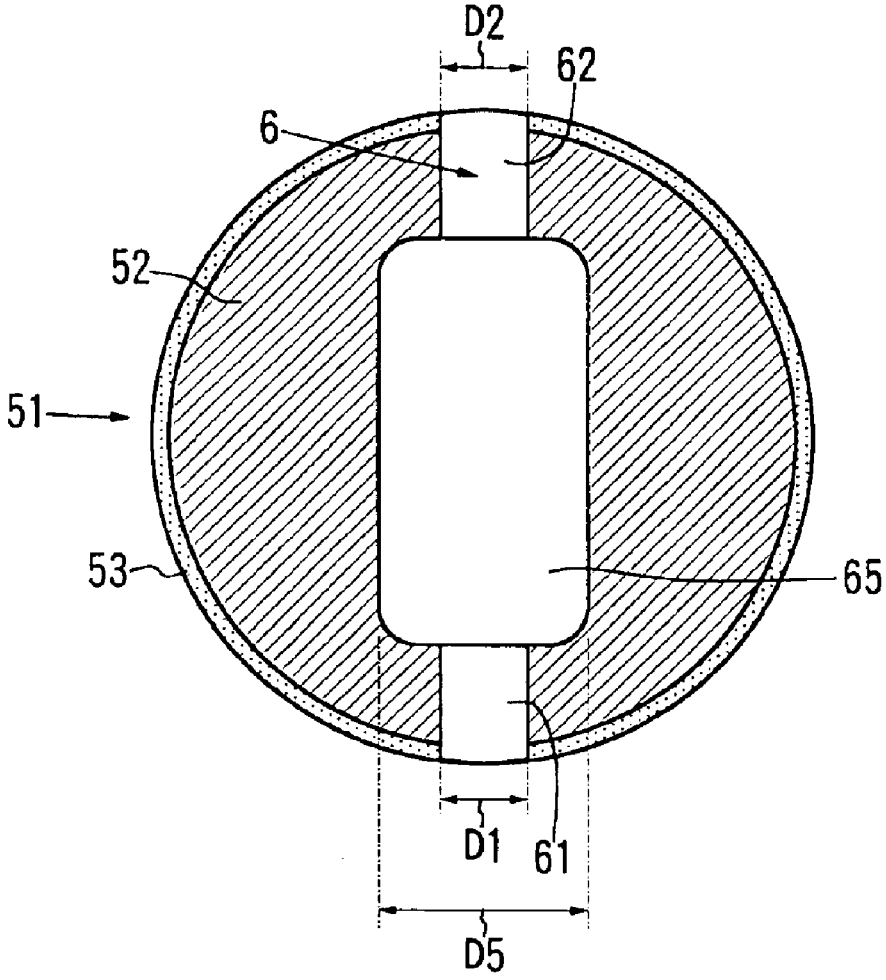
FIG. 9 is a sectional view of the base body contained in the jewel shown in FIG. 8.

FIG. 9 is a sectional view of the base body contained in the jewel shown in FIG. 8. As is shown in FIG. 9, the base body 51 has a hole 6. Since the base body 51 of this embodiment has the same construction as the base body 51 of the jewel shown in FIG. 1, a detailed description is omitted. The base body 51 of this embodiment is a pearl.

Next, the construction of the hole 6 in the base body 51 will be described. The hole 6 opens at the surface of the base body 51. The hole 6 is a hole that passes entirely through the base body 51. The hole 6 shown in the figure has a structure that passes rectilinearly through the base body 51. The hole may also have a structure that passes through the base body so that the hole bends inside the base body, unlike the structure shown in the embodiment illustrated in the figure.

The hole 6 comprises first hole parts 61 and 62 and a second hole part 65. The hole 6 shown in the figure has two first hole parts 61 and 62. The first hole parts 61 and 62 open at the surface of the base body 51. The first hole parts 61 and 62 shown in the figure have substantially cylindrical shapes; one of the two bottom surfaces of each cylinder opens at the surface of the base body 51. The internal diameters D1 and D2 of the first hole parts 61 and 62 are the internal diameters of the cylinders that constitute the first hole parts 61 and 62.

The second hole part 65 is disposed in the interior of the base body 51, and communicates with the first holes parts 61 and 62. Unlike the second hole part 65 in the embodiment shown in FIG. 1, the second hole part 65 in this case has a substantially cylindrical shape. One of the two bottom surfaces of the cylinder constituting the second hole part 65 communicates with the other bottom surface of the cylinder constituting the first hole part 61. The other bottom surface of the cylinder constituting the second hole part 65 communicates with the other bottom surface of the cylinder constituting the first hole part 62.

Furthermore, the second hole part 65 has an internal diameter D5 that is larger than the internal diameters D1 and D2 of the first hole parts 61 and 62. The internal diameter D5 of the second hole part 65 is the internal diameter of the cylinder that constitutes the second hole part 65.

Next, the elastic body 71 will be described with reference to FIG. 8. The elastic body 71 has a through-hole 72, and is inserted into the interior of the hole 6 in the base body 51. The elastic body 71 is in a compressed state inside the hole 6 of the base body 51. The elastic body 71 shown in the figure is made from an organic material such as rubber, a silicone rubber or the like.

At least one open end 721 of the two open ends 721 and 722 of the through-hole 72 in the elastic body 71 communicates with the outside of the base body 51 via the hole 6 in the base body 51. In this embodiment, the hole 6 in the base body 51 is a through-hole as was described above, and the through-hole 72 in the elastic body 71 is also constructed in accordance with such a construction of the hole 6. In concrete terms, the two open ends 721 and 722 of the through-hole 72 respectively communicate with the outside of the base body 51 via the hole 6.

The internal diameter of the through-hole 72 in the elastic body 71 is gradually expanded toward the abovementioned open end 721. In the embodiment, the internal diameter of the through-hole 72 is gradually expanded toward each of the two open ends 721 and 722. In the through-hole 72, the inside surface in the vicinity of the open end 721 is rounded, and the internal diameter of the through-hole 72 is gradually expanded toward the open end 721 as a result of this rounding. Similarly, the inside surface in the vicinity of the open end 722 is rounded, and the internal diameter of the through-hole 72 is gradually expanded toward the open end 722 as a result of this rounding. As an example of an elastic body 71 having such a shape, the elastic body 71 shown in the figure is constituted by a tubular body. In particular, a tubular body constructed from rubber, a silicone rubber or the like is especially suitable. The through-hole 72 passes through the tubular elastic body 71 in the longitudinal direction of the tube. The through-hole 72 has a substantially cylindrical shape. The through-hole in the elastic body may also have a construction in which the internal diameter is expanded toward only one of the open ends, unlike the embodiment shown in the figure.

The elastic body 71 of the embodiment shown in the figure is disposed in the interior of the abovementioned second hole part 65. One open end 721 of the through-hole 72 in the elastic body 71 communicates with the outside of the base body 51 via the first hole part 61, while the other open end 722 communicates with the outside of the base body 51 via the first hole part 62. The elastic body 71 is disposed in the interior of the second hole part 65 so that one open end 721 of the through-hole 72 and the first hole part 61 face each other, and so that the other open end 722 of the through-hole 72 and the first hole part 62 face each other.

In regard to the effects and merits of the jewel shown in FIG. 8, a description of effects and merits that are similar to those of the jewel shown in FIG. 1 will be omitted, and only those effects and merits that are peculiar to the jewel shown in FIG. 8 will be described.

In the jewel shown in FIG. 8, the elastic body 71 is a tubular body. In a case where the elastic body 71 is a tubular body, the elastic body 71 can be inserted into the interior of the hole 6 in the base body 51 by catching the elastic body 71 with catching means using a wire or the like. Accordingly, the elastic body 71 can easily be inserted into the interior of the hole 6.

Figure 10:
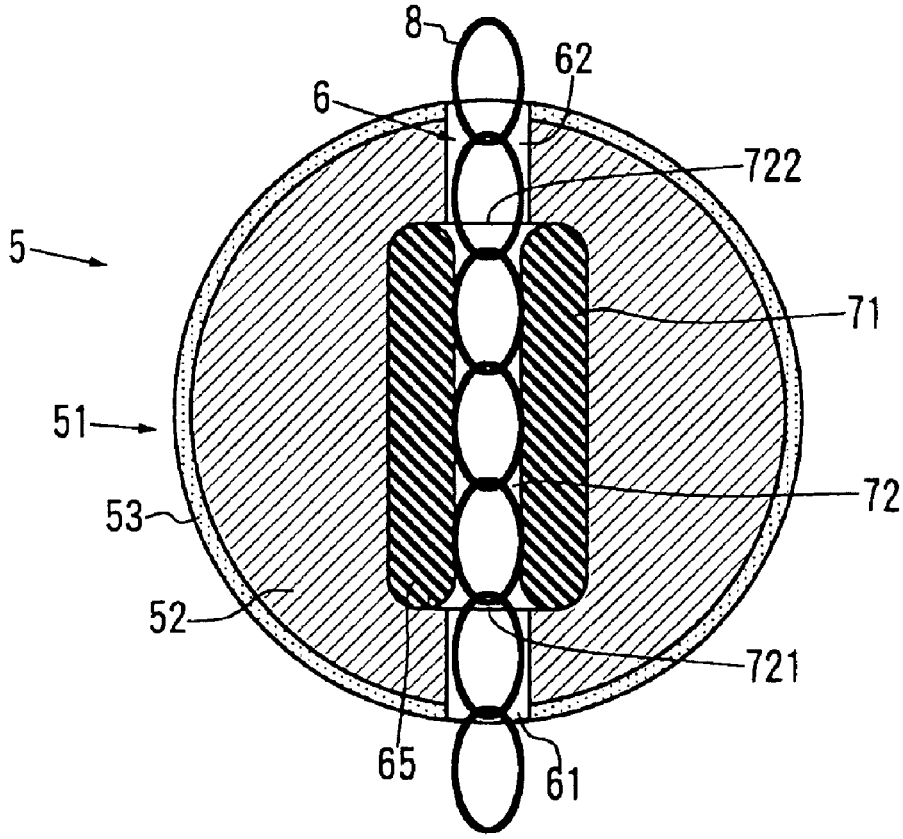
FIG. 10 is a sectional view showing a use configuration of the jewel shown in FIG. 8.

FIG. 10 is a sectional view showing a configuration in use of the jewel shown in FIG. 8. In this figure, the same reference symbols are attached to constituent parts that are the same as constituent parts shown in FIG. 4 or FIG. 8. In this embodiment, as in the embodiment shown in FIG. 1, when a string-form member 8 is inserted into the through-hole 72 of the elastic body 71, a frictional resistance is generated in the string-form member 8 utilizing the elastic force of the elastic body 71, so that the jewel 5 can be securely attached.

In this embodiment, the elastic body 71 is a tubular body, and the through-hole 72 passes through the tubular elastic body 71 in the longitudinal direction of the tube. As is shown in FIG. 10, when a string-form member 8 is inserted into a through-hole 72 having such a structure, the contact area of the string-form body 8 with respect to the through-hole 72 is large. Accordingly, the frictional resistance generated in the string-form member 8 is increased, so that the jewel 5 can be attached even more securely. The same is true in cases where a projection is inserted into the through-hole 72 of the elastic body 71.

Furthermore, a personal ornament similar to the personal ornament shown in FIG. 3 can also be constructed using the jewel of this embodiment. In this case, effects and merits similar to those of the jewel shown in FIG. 1 or the personal ornament shown in FIG. 3 are obtained.

Figure 11:
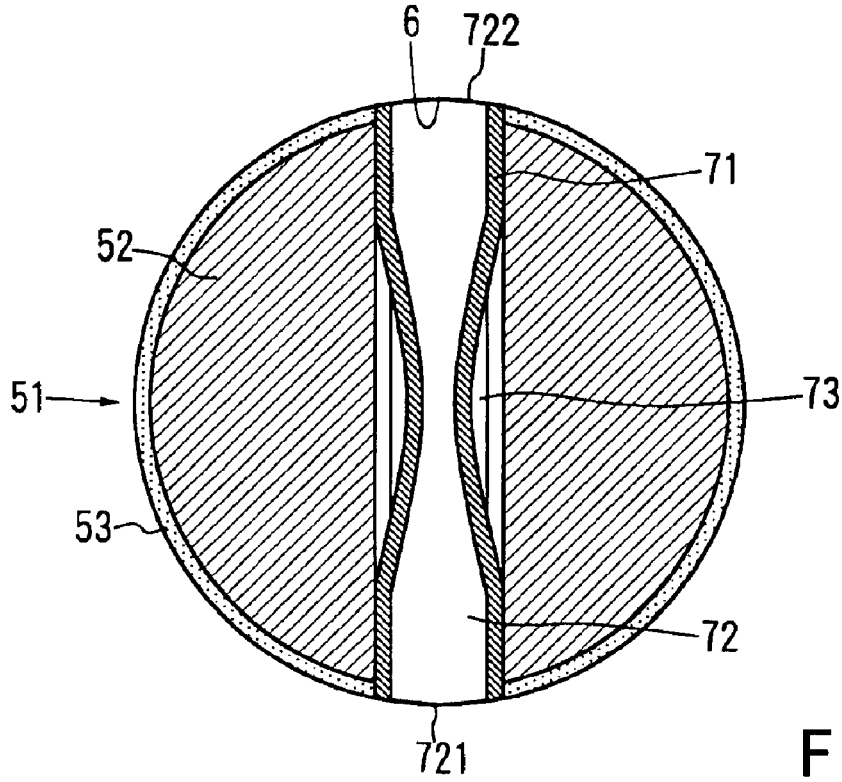
FIG. 11 is a sectional view of still another embodiment of the jewel of the present invention.

FIG. 11 is a sectional view of still another embodiment of the jewel of the present invention. In this figure, the same reference symbols are attached to constituent parts that are the same as constituent parts shown in FIG. 1. The jewel of this embodiment also comprises a base body 51 and an elastic body 71.

Figure 12:
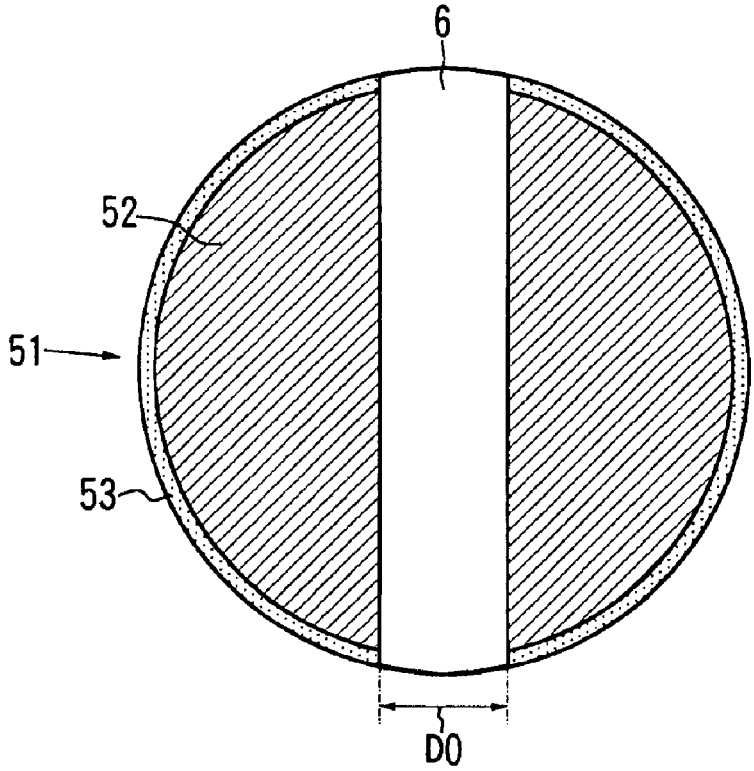
FIG. 12 is a sectional view of the base body contained in the jewel shown in FIG. 11.

FIG. 12 is a sectional view of the base body contained in the jewel shown in FIG. 11. As is shown in FIG. 12, the base body 51 has a hole 6. The base body 51 of this embodiment has the same construction as the base body 51 of the jewel shown in FIG. 1; accordingly, a detailed description is omitted. The base body 51 of this embodiment is also a pearl.

The hole 6 opens at the surface of the base body 51. The hole 6 is a hole that passes entirely through the base body 51. The hole 6 shown in the figure has a structure that passes rectilinearly through the base body 51. The hole 6 shown in the figure has a cylindrical shape, and the two bottom surfaces of the cylinder respective open at the surface of the base body 51. The internal diameter of the hole 6 is designated as D0. The internal diameter D0 of the hole 6 is the internal diameter of the cylinder that constitutes the hole 6.

Next, the elastic body 71 will be described with reference to FIG. 11. The elastic body 71 has a through-hole 72, and is inserted into the interior of the hole 6 in the base body 51. The elastic body 71 is in a compressed state inside the hole 6 of the base body 51. The elastic body 71 shown in the figure is constructed from a metal material. A spring plate material such as phosphorus bronze or the like can be used as the metal material that constitutes the elastic body 71. The elastic body 71 shown in the figure is a tubular body. The through-hole 72 passes through the tubular elastic body 71 in the longitudinal direction of the tube.

At least one open end 721 of the two open ends 721 and 722 of the through-hole 72 in the elastic body 71 communicates with the outside of the base body 51 via the hole 6 in the base body 51. In this embodiment, as in the embodiment shown in FIG. 1, the hole 6 in the base body 51 is a through-hole as was described above, and the through-hole 72 in the elastic body 71 is also constructed in accordance with such a construction of the hole 6. In concrete terms, the two open ends 721 and 722 of the through-hole 72 respectively communicate with the outside of the base body 51 via the hole 6.

The internal diameter of the through-hole 72 in the elastic body 71 is gradually expanded toward the abovementioned open end 721. In the present embodiment, the internal diameter of the through-hole 72 is gradually expanded toward each of the two open ends 721 and 722. To describe this in detail, the internal diameter of the through-hole 72 is small in the intermediate portion of the through-hole 72 between the two open ends 721 and 722, and the internal diameter of the through-hole 72 is gradually expanded from this intermediate portion toward each of the two open ends 721 and 722.

The elastic body 71 is a tubular body as was described above. The tubular elastic body 71 has a plurality of cuts 73. These cuts 73 are located in the intermediate portion of the through-hole 72 between the two open ends 721 and 72, and extend in the longitudinal direction of the tube. The diameter of the through-hole 72 is reduced in the intermediate portion as a result of this plurality of cuts 73, so that a narrow part of the through-hole 72 is formed in the intermediate portion.

Figure 13:
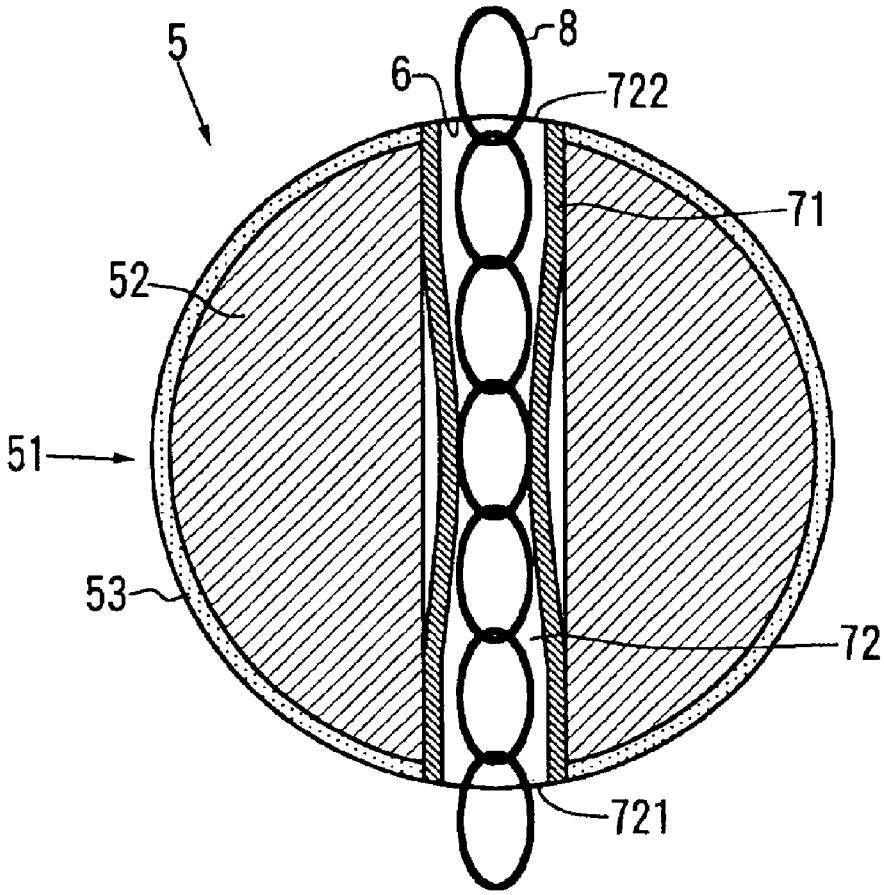
FIG. 13 is a sectional view showing a use configuration of the jewel shown in FIG. 11.

FIG. 13 is a sectional view that illustrates a configuration in use of the jewel shown in FIG. 11. In the figure, the same reference symbols are attached to constituent parts that are the same as constituent parts shown in FIG. 4 or FIG. 11.

In the jewel shown in FIG. 11, as in the jewel shown in the abovementioned FIG. 8, the elastic body 71 is a tubular body; accordingly, the same effects and merits as those of the jewel shown in FIG. 8 are obtained.

In this embodiment, the elastic body 71 is constructed from a metal material. This type of elastic body 71 is superior in terms of durability, wear resistance and the like. Accordingly, superior durability, wear resistance and the like can be ensured in the jewel or personal ornament.

Furthermore, a personal ornament similar to the personal ornament shown in FIG. 3 can also be constructed using the jewel of this embodiment. In this case, the same effects and merits as those of the jewel shown in FIG. 1 or the personal ornament shown in FIG. 3 are obtained.

Figure 14:
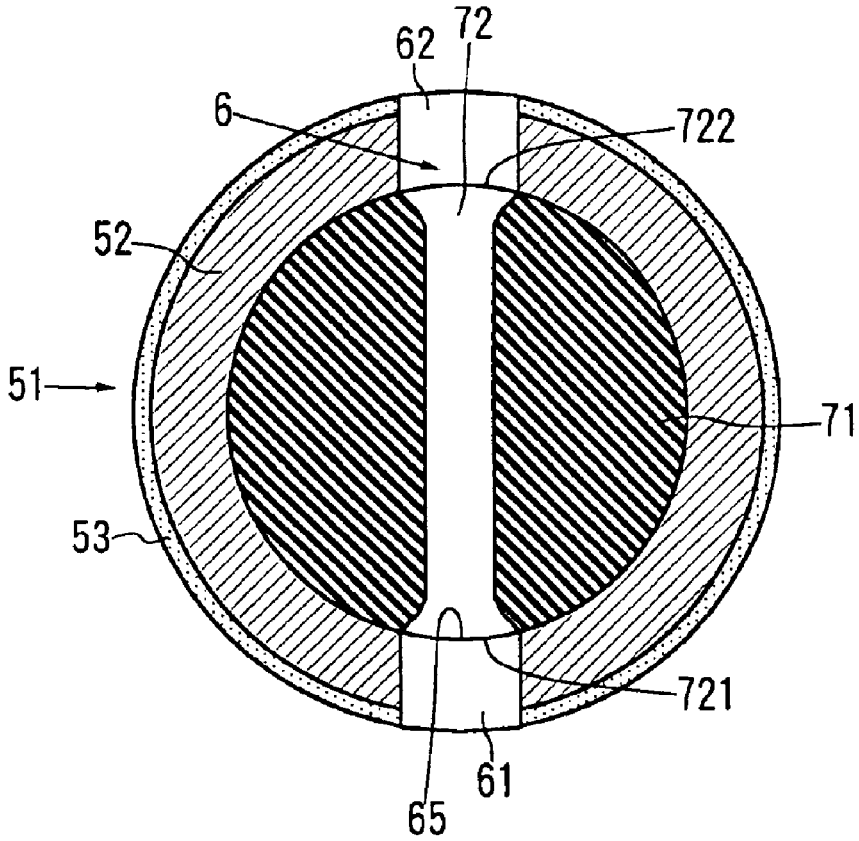
FIG. 14 is a sectional view of still another embodiment of the jewel of the present invention.

FIG. 14 is a sectional view of still another embodiment of the jewel of the present invention. In the figure, the same reference symbols are attached to constituent parts that are the same as constituent parts shown in FIG. 1. The jewel of this embodiment also comprises a base body 51 and an elastic body 71.

Figure 15:
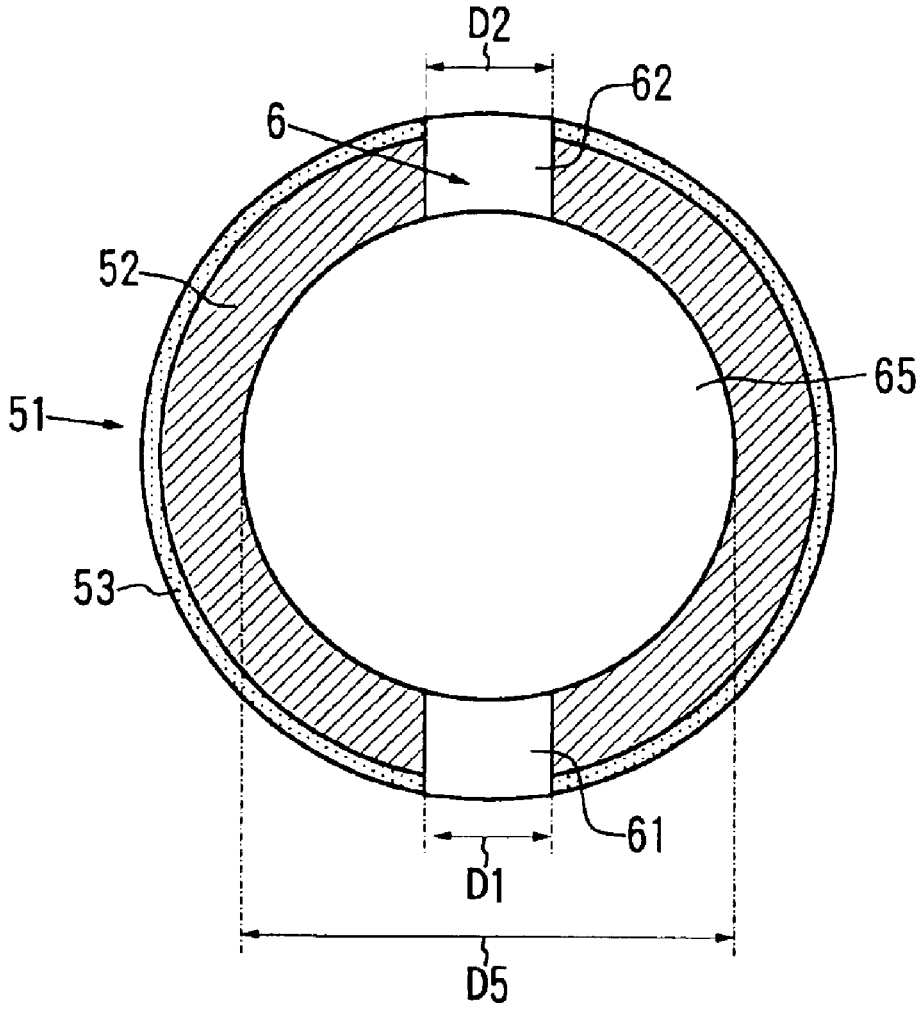
FIG. 15 is a sectional view of the base body contained in the jewel shown in FIG. 14.

FIG. 15 is a sectional view of the base body included in the jewel shown in FIG. 14. As is shown in FIG. 15, the base body 51 has a hole 6. The base body 51 of this embodiment has the same construction as the base body 51 of the jewel shown in FIG. 1; accordingly, a detailed description is omitted. The base body 51 of this embodiment is also a pearl.

Next, the construction of the hole 6 in the base body 51 will be described. The hole 6 opens at the surface of the base body 51. The hole 6 is a hole that passes rectilinearly through the base body 51. The hole 6 shown in the figure has a structure that passes rectilinearly through the base body 51. The hole may also have a structure that passes through the base body so that the hole bends inside the base body, unlike the structure shown in the embodiment illustrated in the figure.

The hole 6 comprises first hole parts 61 and 62 and a second hole part 65. The hole 6 shown in the figure has two first hole parts 61 and 62. The first hole parts 61 and 62 open at the surface of the base body 51. The internal diameters of the first hole parts 61 and 62 are respectively designated as D1 and D2. The first hole parts 61 and 62 shown in the figure have substantially cylindrical shapes, and one of the two bottom surfaces of each cylinder opens at the surface of the base body 51. The internal diameters D1 and D2 of the first hole parts 61 and 62 are the internal diameters of the cylinders that constitute the first hole parts 61 and 62.

The second hole part 65 is disposed in the interior of the base body 51, and communicates with the first hole parts 61 and 62. The second hole part 65 has a substantially spherical shape. The second hole part 65 communicates with the other bottom surfaces of the two bottom surfaces of the cylinders that constitute the first hole parts 61 and 62.

Furthermore, the second hole part 65 has an internal diameter D5 that is larger than the internal diameters D1 and D2 of the first hole parts 61 and 62. The internal diameter D5 of the second hole part 65 is the maximum internal diameter of the spherical shape.

Next, the elastic body 71 will be described with reference to FIG. 14. The elastic body 71 has a through-hole 72, and is inserted into the interior of the hole 6 in the base body 51. The elastic body 71 is in a compressed state inside the hole 6 of the base body 51. The elastic body 71 shown in the figure is constructed from an organic material such as rubber, a silicone rubber or the like.

At least one open end 721 of the two open ends 721 and 722 of the through-hole 72 in the elastic body 71 communicates with the outside of the base body 51 via the hole 6 in the base body 51. In this embodiment, the hole 6 in the base body 51 is a through-hole as was described above, and the through-hole 72 of the elastic body 71 is also constructed in accordance with such a structure of the hole 6. In concrete terms, each of the two open ends 721 and 722 of the through-hole 72 communicates with the outside of the base body 51 via the hole 6.

The internal diameter of the through-hole 72 in the elastic body 71 is gradually expanded toward the abovementioned open end 721. In the embodiment, the internal diameter of the through-hole 72 is gradually expanded toward each of the two open ends 721 and 722. In this embodiment, in the through-hole 72, the inside surface in the vicinity of the open end 721 is rounded, and the internal diameter of the through-hole 72 is gradually expanded toward the open end 721 as a result of this rounding. Similarly, the inside surface in the vicinity of the open end 722 is rounded, and the internal diameter of the through-hole 72 is gradually expanded toward the open end 722 as a result of this rounding. The through-hole 72 in the elastic body 71 has a substantially cylindrical shape. The through-hole in the elastic body may also have a construction in which the internal diameter is expanded toward only one of the open ends, unlike the embodiment shown in the figure.

In the respective embodiments described above, an O-ring or a tubular body is used as the elastic body 71. In the present embodiment, the elastic body 71 is packed inside the hole 6 of the base body 51 instead. An elastic body constructed from rubber, a silicone rubber or the like is suitable as the elastic body 71 that is thus packed.

The elastic body 71 of the embodiment shown in the figure is disposed in the interior of the abovementioned second hole part 65. One open end 721 of the through-hole 72 in the elastic body 71 communicates with the outside of the base body 51 via the first hole part 61, while the other open end 722 communicates with the outside of the base body 51 via the first hole part 62. The elastic body 71 is packed into the second hole part 65.

In the embodiment shown in FIG. 14, the elastic body 71 is packed into the hole part 6 of the base body 51. In the case of such a construction, a high mass production rate can be ensured for the jewel or personal ornament.

Furthermore, in this embodiment, the hole 6 comprises first hole parts 61 and 62 and a second hole part 65. The first hole parts 61 and 62 open at the surface of the base body 51. The second hole part 65 is disposed in the interior of the base body 51, and communicates with the first hole parts 61 and 62. The elastic body 71 is disposed in the interior of the second hole part 65. In the case of such a structure, the elastic body 71 can be protected in the interior of the base body 51 without losing the abovementioned function of the elastic body 71.

Moreover, the second hole part 65 has an internal diameter D5 that is larger than the internal diameters D1 and D2 of the first hole parts 61 and 62. In other words, the internal diameters D1 and D2 of the first hole parts 61 and 62 are smaller than the internal diameter D5 of the second hole part 65. Such a structure is suitable for holding the elastic body 71 in the interior of the second hole part 65.

The elastic body 71 is packed inside the second hole part 65. As a result, the external shape of the packed elastic body 71 is a shape that corresponds to the shape of the second hole part 65, and the external diameter of the elastic body 71 coincides with the internal diameter D5 of the second hole part 65. Furthermore, since the internal diameters D1 and D2 of the first hole parts 61 and 62 are smaller than the internal diameter D5 of the second hole part 65, the elastic body 71 that is packed into the second hole part 65 is securely held inside the second hole part 65.

The second hole part 65 shown in the figure has a substantially spherical shape, so that the external shape of the elastic body 71 that is packed into the second hole part 65 also has a substantially spherical shape corresponding to the shape of the second hole part 65.

Furthermore, a personal ornament similar to the personal ornament shown in FIG. 3 can also be constructed using the jewel of this embodiment. In this case, the same effects and merits as those of the jewel shown in FIG. 1 or the personal ornament shown in FIG. 3 are obtained.

Figure 16:
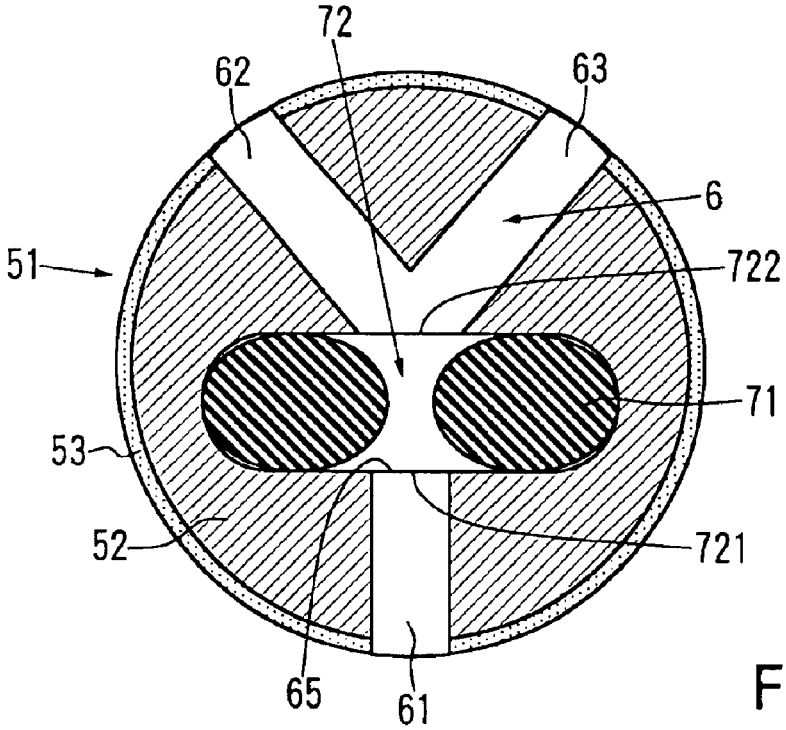
FIG. 16 is a sectional view of still another embodiment of the jewel of the present invention.

FIG. 16 is a sectional view of still another embodiment of the jewel of the present invention. In this figure, the same reference symbols are attached to constituent parts that are the same as constituent parts shown in FIG. 1. The jewel of this embodiment also comprises a base body 51 and elastic body 71.

Figure 17:
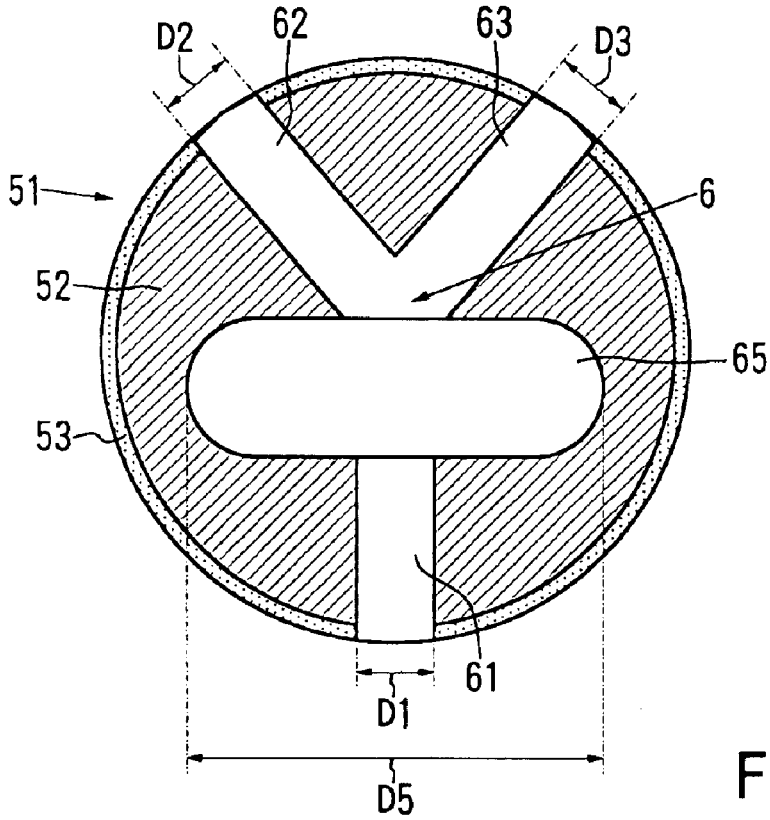
FIG. 17 is a sectional view of the base body contained in the jewel shown in FIG. 16.

FIG. 17 is a sectional view of the base body that is contained in the jewel shown in FIG. 16. As is shown in FIG. 17, the base body 51 has a hole 6. The base body 51 of this embodiment has the same construction as the base body 51 of the jewel shown in FIG. 1; accordingly, a detailed description is omitted. The base body 51 of this embodiment is also a pearl.

Next, the construction of the hole 6 in the base body 51 will be described. The hole 6 opens at the surface of the base body 51. The hole 6 is a hole that passes through the base body 51. Unlike the hole 6 in the embodiment shown in FIG. 1, the hole 6 in this case passes through the base body 51 so that the hole 6 bends inside the base body 51. More specifically, the hole 6 passes through the base body 51 with the direction of passage of this hole 6 bending in the form of a bent line in the interior of the base body 51.

The hole 6 comprises first hole parts 61, 62 and 63, and a second hole part 65. The hole 6 shown in the figure has three first hole parts 61 through 63. The first hole parts 61 through 63 open at the surface of the base body 51. The first hole parts 61 through 63 shown in the figure have substantially cylindrical shapes, and one of the two bottom surfaces of each cylinder opens at the surface of the base body 51. The internal diameters D1 through D3 of the first hole parts 61 through 63 are the internal diameters of the cylinders that constitute the first hole parts 61 through 63.

The second hole part 65 is disposed in the interior of the base body 51. The shape of the second hole part substantially coincides with a flattened spherical shape that is obtained by crushing a spherical body between two plates that are parallel to each other.

Furthermore, the second hole part 65 communicates with the first hole parts 61 through 63. To describe this in detail, one of the two bottom surfaces of the flattened sphere that constitutes the second hole part 65 communicates with the other bottom surface of the cylinder that constitutes the first hole part 61. The other bottom surface of the flattened sphere that constitutes the second hole part 65 communicates with the other bottom surface of the cylinder that constitutes the first hole part 62 and the other bottom surface of the cylinder that constitutes the first hole part 63.

Furthermore, the second hole part 65 has an internal diameter D5 that is larger than the internal diameters D1 through D3 of the first hole parts 61 through 63. The internal diameter D5 of the second hole part 65 is the maximum internal diameter of the flattened spherical shape.

Next, the elastic body 71 will be described with reference to FIG. 16. The elastic body 71 has a through-hole 72, and is inserted into the interior of the hole 6 in the base body 51. The elastic body 71 is in a compressed state inside the hole 6 of the base body 51. The elastic body 71 can be constructed from an organic material, metal material or the like. The elastic body 71 shown in the figure is constructed from an organic substance such as rubber, a silicone rubber or the like.

At least one open end 721 of the two open ends 721 and 722 of the through-hole 72 in the elastic body 71 communicates with the outside of the base body 51 via the hole 6 in the base body 51. In this embodiment, the hole 6 in the base body 51 is a through-hole as was described above, and the through-hole 72 in the elastic body 71 is also constructed in accordance with such a construction of the hole 6. In concrete terms, each of the two open ends 721 and 722 of the through-hole 72 communicates with the outside of the base body 51 via the hole 6.

The internal diameter of the through-hole 72 in the elastic body 71 is gradually expanded toward the abovementioned open end 721. In the embodiment, the internal diameter of the through-hole 72 is gradually expanded toward each of the two open ends 721 and 722. As an example of an elastic body 71 that has such a shape, the elastic body 71 shown in the figure is constituted by an O-ring. In particular, an O-ring constructed from rubber, a silicone rubber or the like is especially suitable. The through-hole in the elastic body may also have a construction in which the internal diameter is expanded toward only one of the open ends, unlike the construction of the embodiment shown in the figure.

The elastic body 71 of the embodiment shown in the figure is disposed in the interior of the abovementioned second hole part 65. One open end 721 of the through-hole 72 in the elastic body 71 communicates with the outside of the base body 51 via the first hole part 61, and the other open end 722 communicates with the outside of the base body 51 via the first hole part 62, and also communicates with the outside of the base body 51 via the first hole part 63. The elastic body 71 is disposed in the interior of the second hole part 65 so that one open end 721 of the through-hole 72 and the first hole part 61 face each other, and so that the other open end 722 of the through-hole 72 and the first hole parts 62 and 63 face each other.

In regard to the effects and merits of the jewel shown in FIG. 16, a description of effects and merits that are similar to those of the jewel shown in FIG. 1 will be omitted, and only those effects and merits that are peculiar to the jewel shown in FIG. 16 will be described.

As was described above, when a string-form member is inserted into the through-hole 72 of the elastic body 71 via the hole 6 in the base body 51, a frictional resistance can be generated in the string-form member utilizing the elastic force of the elastic body 71.

In the jewel shown in FIG. 16, the hole 6 has a structure that passes through the base body 51 so that the hole 6 bends in the interior of the base body 51. Accordingly, an even greater frictional force can be generated in the string-form member, so that the jewel can be attached even more securely.

Furthermore, in the jewel shown in FIG. 16, at least three first hole parts 61 through 63 are disposed so that these first hole parts open at the surface of the base body 51. Moreover, one open end 721 of the two open ends 721 and 722 of the through-hole 72 in the elastic body 71 communicates with the outside of the base body 51 via the first hole part 61. The other open end 722 communicates with the outside of the base body 51 via the first hole part 62, and also communicates with the outside of the base body 51 via the first hole part 63. Accordingly, the string-form member can be passed through the through-hole 72 of the elastic body 71 via the first hole parts 61 and 62. Furthermore, the string-form member can also be passed through the through-hole 72 of the elastic body 71 via the first hole parts 61 and 63. Thus, a plurality of different configurations can be selected as the configurations in which the string-form member is passed through the through-hole 72 of the elastic body 71.

Furthermore, a personal ornament similar to the personal ornament shown in FIG. 3 can also be constructed using the jewel of this embodiment. In this case, effects and merits similar to those of the jewel shown in FIG. 1 or the personal ornament shown in FIG. 3 are obtained.

Figure 18:
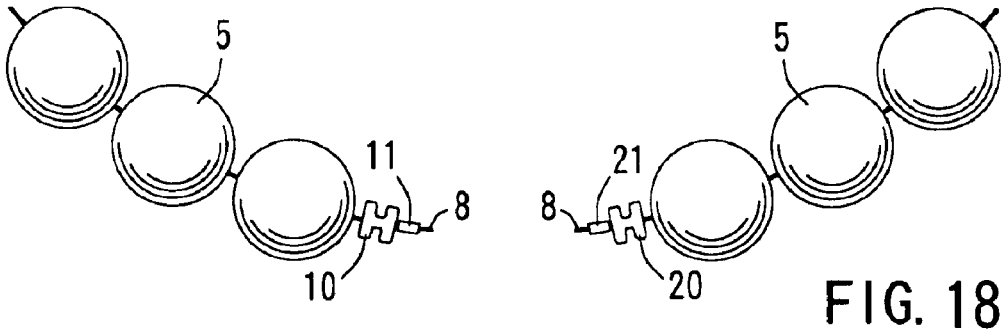
FIG. 18 is a perspective view of another embodiment of a personal ornament using the jewel shown in FIG. 1.

FIG. 18 is a perspective view of another embodiment of a personal ornament using the jewel shown in FIG. 1. In the figure, the same reference symbols are attached to constituent parts that are the same as constituent parts shown in FIG. 3. The personal ornament of this embodiment also comprises jewels 5 and a joining member 8. The personal ornament shown in the figure is a necklace. Besides this, the personal ornament may also be a bracelet, anklet or the like. The jewels 5 are jewels of the present invention as shown in FIG. 1.

The joining member 8 is inserted into the through-holes 72 of the elastic bodies 71 contained in the jewels 5, and is elastically held in the through-holes 72. The joining member 8 is a string-form member. The string-form joining member 8 can be constructed from a chain, metal wire, fibers or a combination of these. The joining member 8 shown in the figure is constituted by a chain. The string-form joining member 8 will hereafter be referred to as the "string-form member 8". The string-form member 8 has two end parts.

A plurality of jewels 5 are used. The string-form member 8 is passed through the plurality of jewels 5 so that the jewels 5 are disposed on the string-form member 8 in the manner of a string of beads. The plurality of jewels 5 are disposed on the string-form member 8 between one end part of the string-form member 8 and the other end part of the string-form member 8.

The personal ornament shown in FIG. 18 further comprises first connecting means 10 and second connecting means 20. The first connecting means 10 are disposed on one end part of the string-form member 8. The second connecting means 20 are disposed on the other end part of the string-form member 8.

Figure 19:
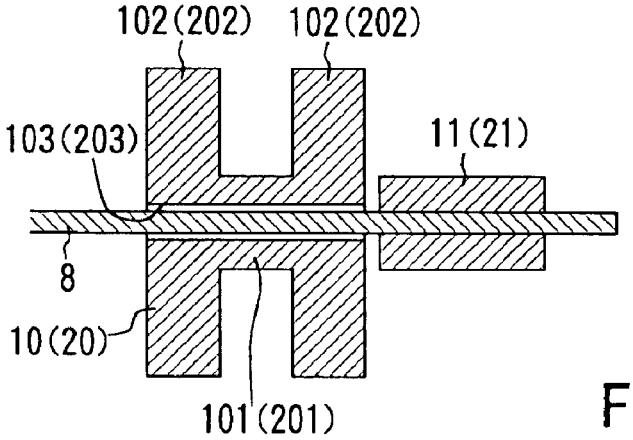
FIG. 19 is an enlarged sectional view showing the first and second connecting means contained in the personal ornament shown in FIG. 18.

FIG. 19 is an enlarged sectional view showing the first and second connecting means contained in the personal ornament shown in FIG. 18. As is shown in FIG. 19, the first connecting means 10 comprise a first neck part 101 and two first protruding parts 102. The two first protruding parts 102 are disposed on both ends of the first neck part 101, and respectively have diameters that are larger than the diameter of the first neck part 101. The first connecting means 10 have a first through-hole 103 that passes through the interior of the first connecting means 10. The first through-hole 103 passes through the first neck part 101 and the two first protruding parts 102. One end part of the abovementioned string-form member 8 is led out via the first through-hole 103 of the first connecting means 10, and a fastening member 11 is fastened to the led-out portion. The fastening member 11 is fastened to the string-form member 8 by press-bonding, adhesion or the like.

As is shown in FIG. 19, the second connecting means 20 comprise a second neck part 201 and two second protruding parts 202. The two second protruding parts 202 are disposed on both ends of the second neck part 201, and respectively have diameters that are larger than the diameter of the second neck part 201. The second connecting means 20 have a second through-hole 203 that passes through the interior of the second connecting means 20. The second through-hole 203 passes through the second neck part 201 and the two second protruding parts 202. The other end part of the above-mentioned string-form member 8 is led out via the second through-hole 203 of the second connecting means 20, and a fastening member 21 is fastened to the led-out portion.

The shapes of the first and second connecting means 10 and 20 shown in the figure resemble the shape of a dumbbell. The shapes of the first and second connecting means 10 and 20, and especially the shapes of the protruding parts 102 and 202, may differ from the shapes shown in the figure.

As is shown in FIG. 19, the first connecting means 10 have a first through-hole 103 that passes through the interior of the first connecting means 10. As a result of the use of such a structure, one end of the string-form member 8 of the personal ornament can be led out via the first through-hole 103 of the first connecting means 10, and the fastening member 11 can be fastened to the led-out portion. As a result, the first connecting means 10 can be attached to one end of the string-form member 8. The same is true of the second connecting means 20.

The construction whereby the first and second through-holes 103 and 203 are disposed in the first and second connecting means 10 and 20 is merely an example. The first and second connecting means can be attached to both ends of the string-form member by utilizing means such as soldering, press-bonding or the like even in cases where the first and second connecting means have no first or second through-holes (unlike the embodiment shown in the figure).

Figure 20:
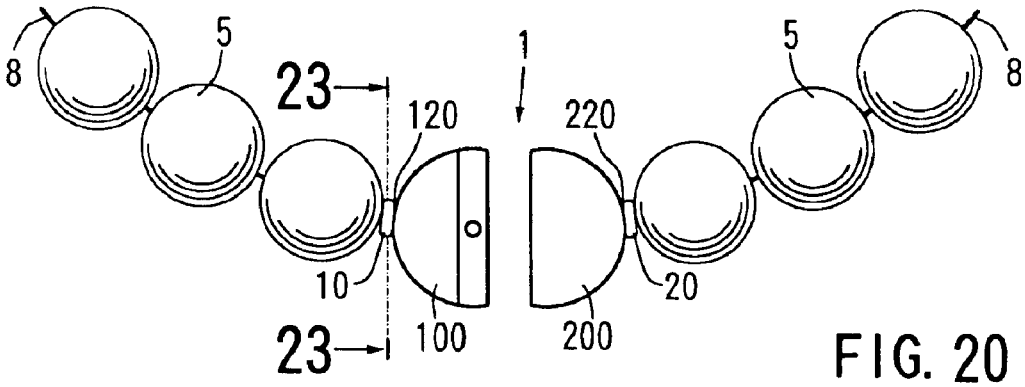
FIG. 20 is a perspective view showing the joining step of the personal ornament shown in FIG. 18.
Figure 21:
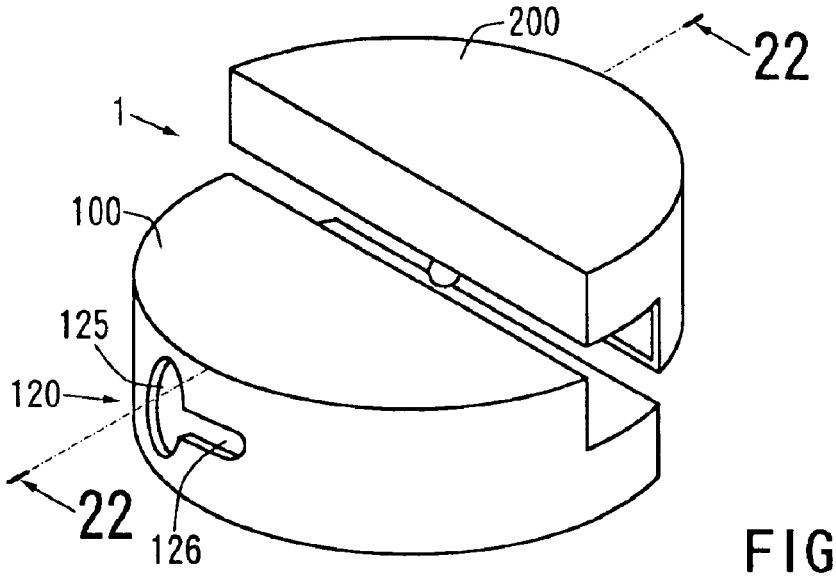
FIG. 21 is a perspective view of the fastening fitting used in the joining of the personal ornament shown in FIG. 18.
Figure 22:
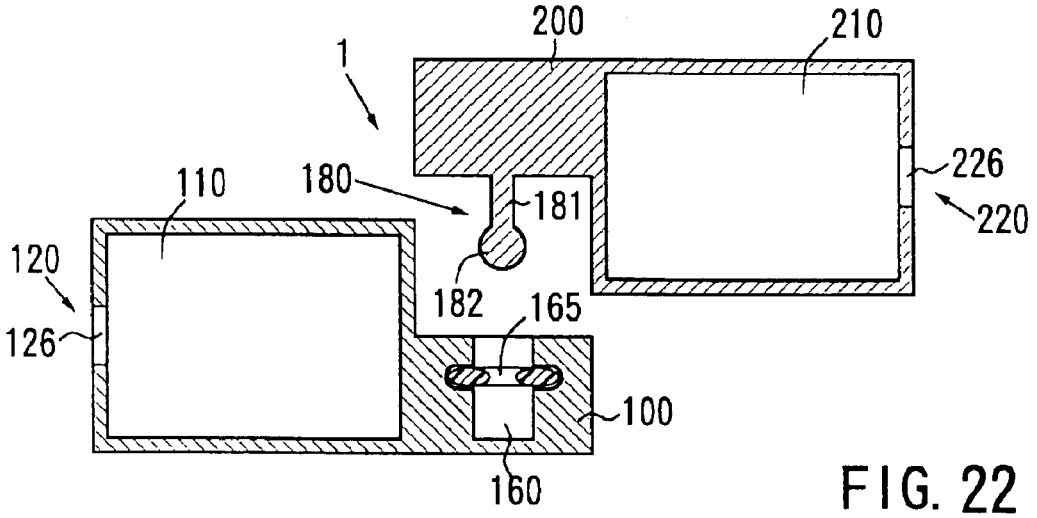
FIG. 22 is a sectional view along line 22—22 in FIG. 21.

FIG. 20 is a perspective view illustrating the joining step of the personal ornament shown in FIG. 18, and FIG. 21 is a perspective view of the fastening fitting used in the joining of the personal ornament shown in FIG. 18. FIG. 22 is a sectional view along line 22—22 in FIG. 21. In the figures, the reference symbol 1 indicates the fastening fitting. As is shown in FIGS. 21 and 22, the fastening fitting 1 comprises a first fastening member 100 and a second fastening member 200.

The first fastening member 100 has an opening part 160; this opening part 160 accommodates an elastic O-ring 165 inside. The second fastening member 200 has a protruding part 180. This protruding part 180 fits in the opening part 160.

The first fastening member 100 further comprises first external fastening means 120, and the second fastening member 200 further comprises second external fastening means 220. In the fastening fitting 1 shown in the figures, the first fastening member 100 has a first hole that opens at the surface of the first fastening member 100, and the above-mentioned first external connecting means 120 are formed by this first hole. Similarly, the second fastening member 200 likewise has a second hole that opens at the surface of the second fastening member 200, and the abovementioned second external connecting means 220 are formed by this second hole.

Figure 23:
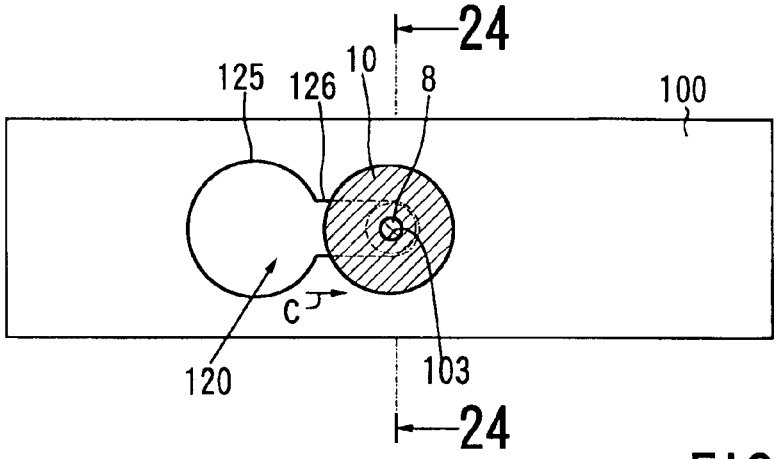
FIG. 23 is an enlarged sectional view along line 23—23 in FIG. 20.
Figure 24:
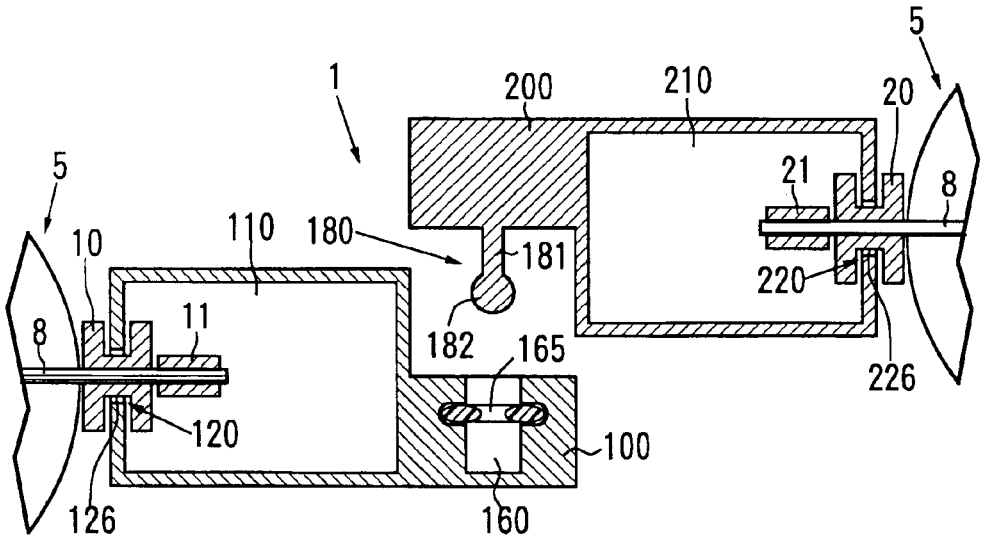
FIG. 24 is a sectional view along line 24—24 in FIG. 23.

FIG. 23 is an enlarged sectional view along line 23—23 in FIG. 20, and FIG. 24 is a sectional view along line 24—24 in FIG. 23. The sectional view shown in FIG. 24 corresponds to the sectional view shown in FIG. 22. In the abovementioned fastening fitting 1, the first fastening member 100 comprises first external connecting means 120, and the second fastening member 200 comprises second external connecting means 220. In order to join the personal ornament equipped with the first and second connecting means 10 and 20 utilizing the fastening fitting 1, the first external connecting means 120 of the first fastening member 100 and the first connecting means 10 of the personal ornament are connected while the fastening fitting 1 is in an open state as shown in FIG. 20 (see FIGS. 23 and 24). Furthermore, the second external connecting means 220 of the second fastening member 200 and the second connecting means 20 of the personal ornament are connected.

Figure 25:
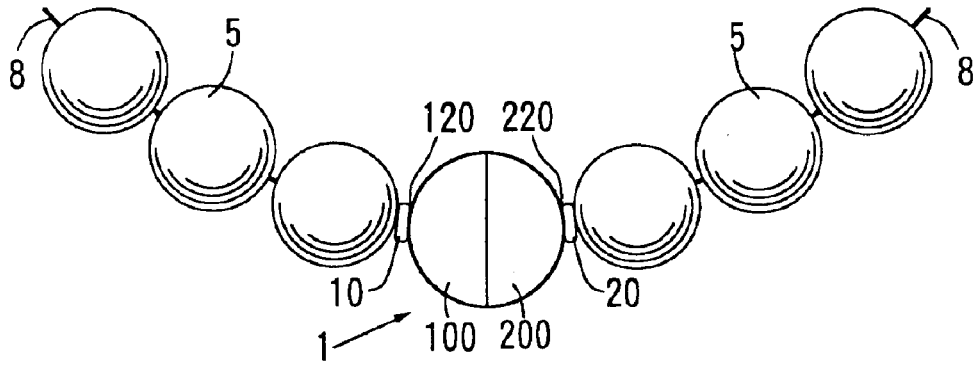
FIG. 25 is a perspective view showing the joining step following the joining step shown in FIG. 20.
Figure 26:
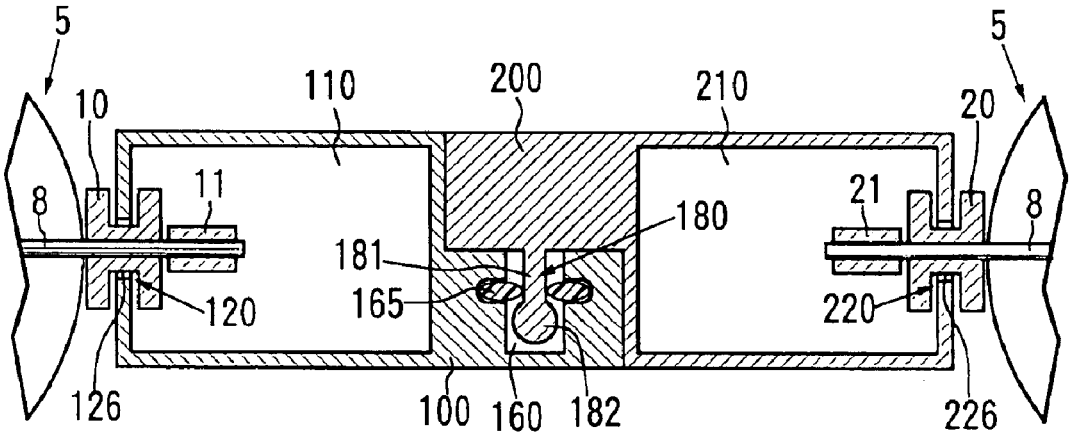
FIG. 26 is a sectional view corresponding to the sectional view in FIG. 24, and is a sectional view in the joining step shown in FIG. 25.

FIG. 25 is a perspective view that illustrates the joining step that follows the joining step shown in FIG. 20. FIG. 26 is a sectional view corresponding to the sectional view shown in FIG. 24, and is a sectional view in the joining step shown in FIG. 25. In the fastening fitting 1, the first fastening member 100 has an opening part 160, and the second fastening member 200 has a protruding part 180. Accordingly, following the joining step shown in FIG. 20, the protruding part 180 of the second fastening member 200 can be inserted into the opening part 160 of the first fastening member 100. The first fastening member 100 and second fastening member 200 are detachably joined to each other when the protruding part 180 is inserted into the opening part 160.

Accordingly, the first connecting means 10 and second connecting means 20 installed in the personal ornament assume a state in which these means are connected to each other via the first fastening member 100 and second fastening member 200, so that the personal ornament is joined. Consequently, the work of joining the personal ornament is simple.

When the protruding part 180 of the second fastening member 200 is pulled out of the opening part 160 of the first fastening member 100, the joining of the first fastening member 100 and second fastening member 200 is released. Accordingly, the connection between the first and second connecting means 10 and 20 of the personal ornament is broken, so that the joining of the personal ornament is released. Consequently, the operation used to release the joining of the personal ornament is also simple.

When the fastening fitting 1 is closed as described above, the protruding part 180 of the second fastening member 200 is pushed into the opening part 160 of the first fastening member 100. Furthermore, since an elastic O-ring 165 is contained in the opening part 160, and since the protruding part 180 fits into the abovementioned opening part 160, the protruding part 180 that has been pushed into the opening part 160 assumes a state in which this protruding part 180 is held by the elastic O-ring 165 contained in the opening part 160. Accordingly, when the fastening fitting 1 is closed as described above, the first fastening member 100 and second fastening member 200 are tightly joined. As a result, the personal ornament can be joined with high reliability using the fastening fitting 1.

The opening part 160 of the first fastening member 100 and the protruding part 180 of the second fastening member 200 in the abovementioned fastening fitting 1 will now be described in greater detail.

The opening part 160 contains an elastic O-ring 165. The opening part 160 has a recess with an expanded diameter in the intermediate portion of the opening part 160 (with respect to the depth of the opening part 160). An elastic O-ring 165 is inserted into this recess. The elastic O-ring 165 has a doughnut shape, and is constructed from a material such as silicone or the like which possesses elasticity. The external diameter of the elastic O-ring 165 corresponds to the diameter of the recess disposed in the opening part 160, and the elastic O-ring 165 is securely held in the interior of this recess.

As was described above, the second fastening member 200 has a protruding part 180, and this protruding part 180 fits into the opening part 160. The protruding part 180 has a neck part 181, and the neck part 181 has an expanded part 182 on the tip end of the neck part 181. This expanded part 182 has a diameter that is larger than the diameter of the neck part 181, and that is larger than the internal diameter of the elastic O-ring 165. The expanded part 182 has a spherical shape.

When the second fastening member 200 is pushed toward the first fastening member 100, or the first fastening member 100 is pushed toward the second fastening member 200, a pressing force is applied to the elastic O-ring 165 by the expanded part 182 of the protruding part 180. As a result of this pressing force, the internal diameter of the elastic O-ring 165 gradually increases.

When the second fastening member 200 is pushed further toward the first fastening member 100, or the first fastening member 100 is pushed further toward the second fastening member 200, a further pressing force is applied to the elastic O-ring 165 by the expanded part 182 of the protruding part 180. As a result of this pressing force, the internal diameter of the elastic O-ring 165 is increased even further. Then, when the internal diameter of the elastic O-ring 165 reaches the size of the diameter of the expanded part 182, the expanded part 182 passes through the elastic O-ring 165. Afterward, the internal diameter of the elastic O-ring 165 returns to the initial dimension, so that the elastic O-ring 165 surrounds the neck part 181 of the protruding part 180 (see FIG. 25).

The fastening fitting 1 can be simply closed by virtue of the combined structure of the abovementioned protruding part 180 and opening part 160, and can be securely held by virtue of the elasticity of the elastic O-ring 165 and the shape of the protruding part 180.

When the second fastening member 200 is pulled so that this second fastening member 200 is separated from the first fastening member 100, or when the first fastening member 100 is pulled so that this first fastening member 100 is separated from the second fastening member 200, a force is applied to the elastic O-ring 165 by the expanded part 182 of the protruding part 180. The diameter of the elastic O-ring 165 is gradually increased by this force. Then, when the internal diameter of the elastic O-ring 165 reaches the size of the diameter of the expanded part 182, the expanded part 182 slips out of the elastic O-ring 165. As result, the fastening fitting 1 is opened.

In the fastening fitting 1 shown in FIG. 21, an opening part 160 is disposed in the first fastening member 100, and a protruding part 180 is disposed on the second fastening member 200. It is evident that the same effects and merits can also be obtained in a case where a protruding part is disposed on the first fastening member and an opening part is disposed in the second fastening member (in a construction differing from that of the fastening fitting 1 shown in FIG. 21).

In the fastening fitting 1, as was described with reference to FIGS. 21 and 22, the first fastening member 100 has a first hole that opens in the surface of the first fastening member 100, and first external connecting means 120 are formed by this first hole. Similarly, the second fastening member 200 likewise has a second hole that opens in the surface of the second fastening member, and second external fastening means 220 are likewise formed by this second hole.

The construction of the first hole 120 that forms the first external connecting means will be described in detail. As is shown in FIG. 22, the first fastening member 100 also has a first internal space 110. As is shown in FIGS. 21 and 22, the first hole 120 has a first insertion part 125 and a first rail part 126. The first rail part 126 has a width that is smaller than the width of the first insertion part 125, and this first rail part 126 forms a continuation of the first insertion part 125. The first insertion part 125 and first rail part 126 communicate with the first internal space 110.

The construction of the second hole 220 that forms the second external connecting means is similar to the construction of the abovementioned first hole 120, but will be described here. As is shown in FIG. 22, the second fastening member 200 also has a second internal space 210. The second hole 220 has a second insertion part 225 and a second rail part 226. The second rail part 226 has a width that is smaller than the width of the second insertion part 225, and forms a continuation of the second insertion part 225. The second insertion part 225 and second rail part 226 communicate with the second internal space 210.

Next, the connection of the first connecting means 10 of the personal ornament and the first external connecting means 120 of the fastening fitting 1 will be described in detail with reference to FIGS. 19, 23 and 24. The shape and dimensions of the first connecting means 10 coincide with the shape and dimensions of the first hole 120 that constitutes the first external connecting means. To describe this in detail, the dimensions (diameter) of the first protruding part 102 of the first connecting means 10 are slightly smaller than the dimensions (diameter) of the first insertion part 125 of the first hole 120. Furthermore, the diameter of the first neck part 101 of the first connecting means 10 coincides with the width of the first rail part 126 of the first hole 120.

When the first connecting means 10 is to be connected to the first external connecting means 120, the first protruding part 102 of the first connecting means 10 is first inserted into the first insertion part 125 of the first hole 120. Since the dimensions (diameter) of the first protruding part 102 are slightly smaller than the dimensions (diameter) of the first insertion part 125, the first protruding part 102 can be smoothly inserted into the first insertion part 125.

Next, the first protruding part 102 that has been inserted is moved from the first insertion part 125 to the first rail part 126 (see the arrow C in FIG. 23). Since the diameter of the first neck part 101 of the first connecting means 10 coincides with the width of the first rail part 126 of the first hole 120, the first protruding part 102 can be smoothly moved to the first rail part 126.

The constructions of the second connecting means 20 and second external connecting means 220 are similar to the constructions of the abovementioned first connecting means 10 and first external connecting means 120; accordingly, a description is omitted here. The second connecting means 20 is connected to the second external connecting means 220 in the same manner as the abovementioned first connecting means 10 and first external connecting means 120.

Figure 27:
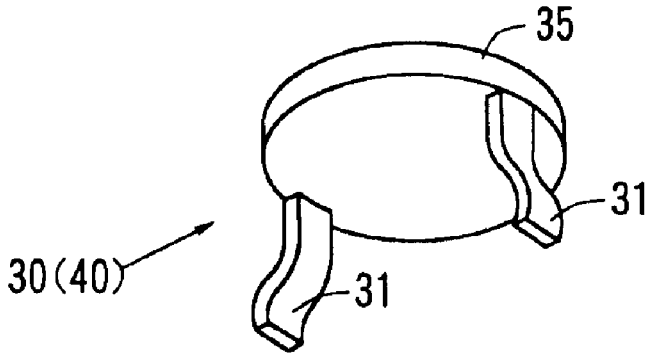
FIG. 27 is a perspective view of the first and second plugs used in the fastening fitting shown in FIGS. 21 and 22.
Figure 28:
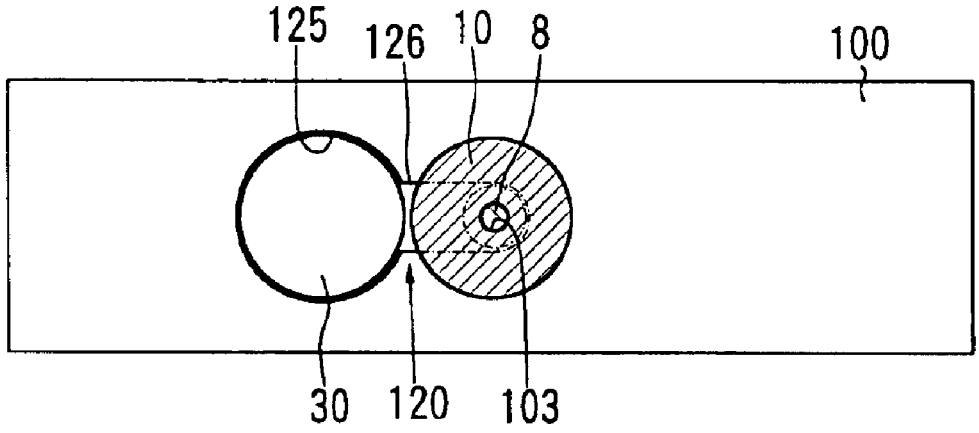
FIG. 28 is an enlarged sectional view corresponding to the enlarged sectional view shown in FIG. 23, and is an enlarged sectional view showing the conditions of use of the first plug.

FIG. 27 is a perspective view of first and second plugs used in the fastening fitting shown in FIGS. 21 and 22. FIG. 28 is an enlarged sectional view that corresponds to the enlarged sectional view shown in FIG. 23, and is an enlarged sectional view illustrating the conditions of use of the first plug. The fastening fitting shown in FIG. 1 preferably includes a first plug 30 and second plug 40. The first plug 30 is used in the first fastening member 100 of the fastening fitting, and the second plug 40 is used in the second fastening member 200 of the fastening fitting.

As is shown in the figures, the first plug 30 has a shape that fits the shape of the first insertion part 125 of the first hole 120. The first plug 30 has a blocking part 35 and two legs 31; the shape of the blocking part 35 fits the shape of the first insertion part 125. A construction without legs may also be used as the construction of the first plug. Like the first plug 30, the second plug 40 also has a shape that fits the shape of the second insertion part 225 of the second hole 220, although this is not shown in the figures.

As has already been described with reference to FIGS. 23 and 24, the first protruding part 102 of the first connecting means 10 is inserted into the first insertion part 125, and the first protruding part 102 that has thus been inserted is moved to the first rail part 126 (see the arrow b in FIG. 23). Here, the first plug 30 is utilized. Since the first plug 30 has a shape that fits the shape of the first insertion part 125 of the first hole 120, the first insertion part 125 can be blocked by the first plug 30. As a result of such an operation of the first plug 30, the first protruding part 102 of the first connecting means 10 can be prevented from slipping out of the first external connecting means (first hole) 120 of the first fastening member 100.

The function of the second plug 40 is similar to the function of the abovementioned first plug 30; accordingly, a description is omitted.

In the personal ornaments shown in FIGS. 18 and 20 above, the jewels 5 are the same as the jewel shown in FIG. 1. However, these jewels 5 could also be replaced by the jewels shown in FIG. 8, 11, 14 or 16.

Figure 29:
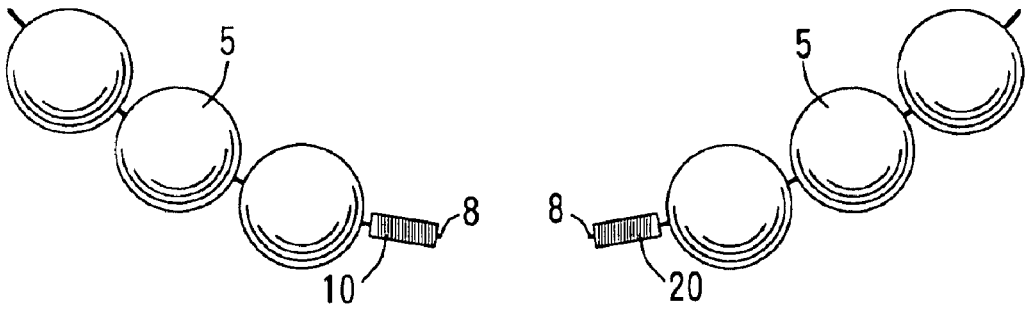
FIG. 29 is a perspective view of still another embodiment of a personal ornament using the jewel shown in FIG. 1.

FIG. 29 is a perspective view of still another embodiment of a personal ornament using the jewel shown in FIG. 1. In the figure, the same reference symbols are attached to constituent members that are the same as constituent members shown in FIG. 18, and a description of these constituent members is omitted. The characterizing features of the personal ornament shown in FIG. 29 in comparison with the personal ornament shown in FIG. 18 lie in the structures of the first and second connecting means 10 and 20.

Figure 30:
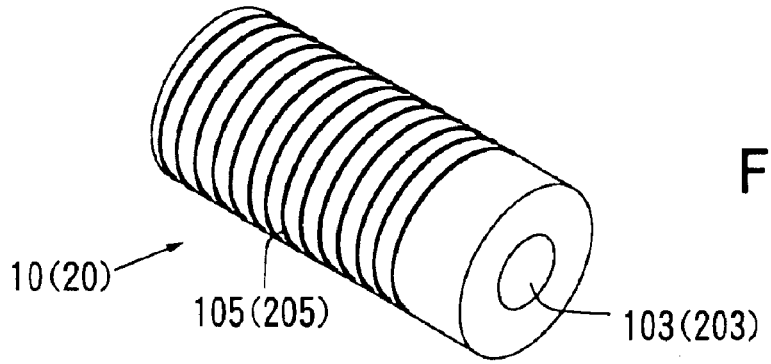
FIG. 30 is an enlarged sectional view of the first and second connecting means contained in the personal ornament shown in FIG. 29.

FIG. 30 is an enlarged perspective view of the first and second connecting means contained in the personal ornament shown in FIG. 29. As is shown in FIG. 30, the first connecting means 10 have a screw part 105 on the surface of the connecting means. The first connecting means 10 have a substantially cylindrical shape, and have a first through-hole 103 that passes through the interior. The second connecting means 20 also have a screw part 205 on the surface of the connecting means. The second connecting means 20 also have a substantially cylindrical shape, and have a second through-hole 203 that passes through the interior.

Figure 31:
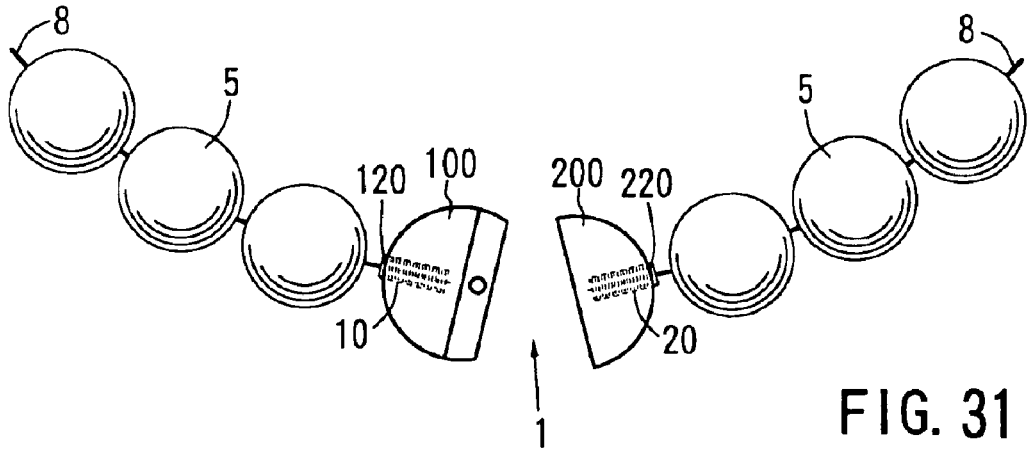
FIG. 31 is a perspective view showing the joining step of the personal ornament shown in FIG. 29.
Figure 32:
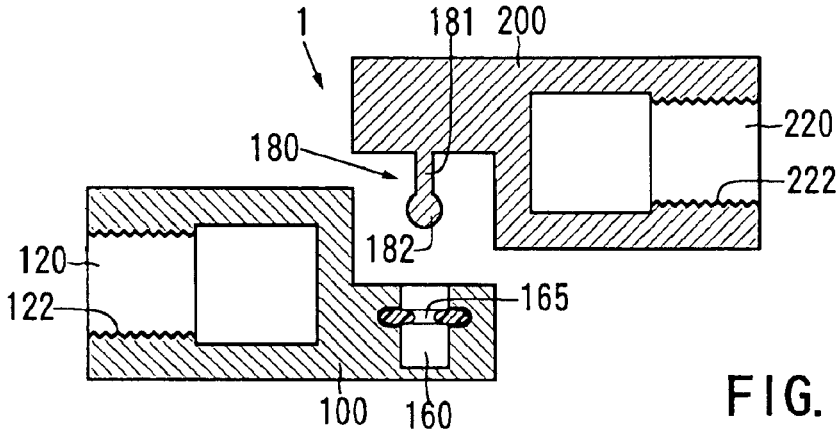
FIG. 32 is a sectional view of the fastening fitting used in the joining of the personal ornament shown in FIG. 29.

FIG. 31 is a perspective view that illustrates the joining step of the personal ornament shown in FIG. 29, and FIG. 32 is a sectional view of the fastening fitting used in the joining of the personal ornament shown in FIG. 29. In these figures, the reference symbol 1 indicates the fastening fitting. In these figures, the same reference symbols are attached to constituent parts that are the same as constituent parts shown in FIGS. 21 and 22, and a description of these constituent parts is omitted.

Next, the characterizing features of the fastening fitting shown in FIG. 32 (in comparison with the fastening fittings shown in FIGS. 21 and 22) will be described. The first fastening member 100 has a screw part 122 on the inside wall of the first hole 120, and first external connecting means are formed by the first hole 120. Similarly, the second fastening member 200 also has a screw part 222 on the inside wall of the second hole 220, and first external connecting means are formed by the second hole 220.

Figure 33:
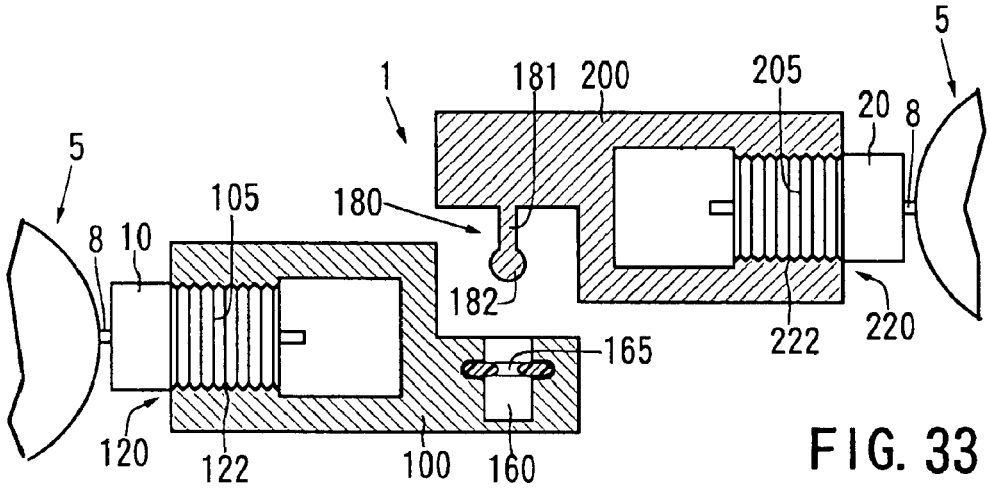
FIG. 33 is a partial sectional view corresponding to the sectional view shown in FIG. 32, and is a partial sectional view which illustrates the joining step shown in FIG. 31.

FIG. 33 is a partial sectional view corresponding to the sectional view shown in FIG. 32, and is a partial sectional view that illustrates the joining step shown in FIG. 31. In order to join a personal ornament equipped with the first and second connecting means 10 and 20 utilizing the fastening fitting 1, the external connecting means 120 of the first fastening member 100 and the first connecting means 10 of the personal ornament are connected in a state in which the fastening fitting 1 is open as shown in FIG. 31 (see FIG. 33). Furthermore, the second external connecting means 220 of the second fastening member 200 and the connecting means 20 of the personal ornament are connected (see FIG. 33).

Next, the connection of the first external connecting means 120 and the first connecting means 10 will be described in concrete terms. The first external connecting means 120 are formed by the first hole, and the first connecting means 10 are inserted into the first hole 120 while being screwed in. As a result, the screw part 105 disposed on the surface of the first connecting means 10 is joined to the screw part 122 disposed on the inside wall of the first hole 120.

Next, the connection of the second external connecting means 220 and the second connecting means 20 will be described in concrete terms. The second external connecting means 220 are formed by the second hole, and the second connecting means 20 are inserted into the abovementioned second hole 220 while being screwed in. As a result, the screw part 205 disposed on the surface of the second connecting means 20 is joined to the screw part 222 disposed on the inside wall of the second hole 220.

Figure 34:
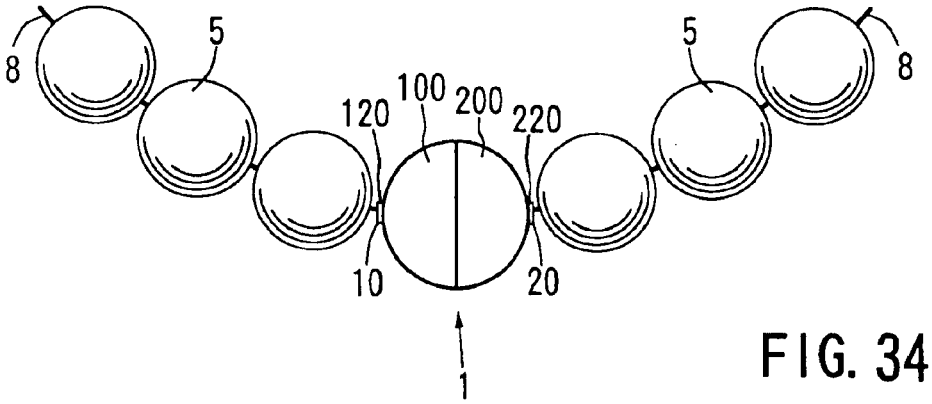
FIG. 34 is a perspective view showing the joining step that follows the joining step shown in FIG. 31.

FIG. 34 is a perspective view showing the joining step that follows the joining step shown in FIG. 31. When the protruding part 180 of the second fastening member 200 is inserted into the opening part 160 of the first fastening member 100 following the joining step shown in FIG. 31, the first fastening member 100 and second fastening member 200 are detachably joined to each other. Accordingly, as is shown in FIG. 34, the first connecting means 10 and second connecting means 20 disposed on the personal ornament are connected to each other via the first fastening member 100 and second fastening member 200, so that the personal ornament is joined.

In the personal ornaments shown in FIGS. 29 and 31 above, the jewels 5 are the same as the jewel shown in FIG. 1. However, these jewels 5 could also be replaced by the jewels shown in FIG. 8, 11, 14 or 16.

As was described above, the present invention makes it possible to provide a jewel which can be securely attached to a string-form member or pedestal with a stable frictional force, and which can be easily removed from such a string-form member or pedestal, and a personal ornament using this jewel.

What is claimed is:

1. A personal ornament comprising a jewel and string, wherein:

said jewel includes a base body and an elastic body:

said base body includes a pearl layer surrounding matrix material and having a hole defined by the pearl layer and the matrix material, said hole comprising two first hole parts and a second hole part;

the first hole parts are provided at positions facing opposite each other over the second hole part, and each of the first hole parts extends from a surface of the pearl layer to an interior of the matrix material to open at the second hole part;

said second hole part is disposed only in the interior of said matrix material, and the second hole part has an internal diameter defined by an inner surface of the matrix material that is larger than internal diameters of said first hole parts defined by the inner surface of the matrix material;

said elastic body is constructed from an organic material and has a through-hole and is disposed in the interior of said second hole part, one open end of said through-hole communicating with an outside of said base body via one first hole part, another open end of the through-hole communicating with the outside of the base body via the other first hole part, and the internal diameter of said through-hole being gradually expanded toward each of the open ends; and said string is passed through the one first hole part, the through-hole, and the other first hole part, and the string is held in an elastic manner to permit sliding of the string relative to the elastic body.

2. The personal ornament according to claim 1, wherein:

said jewel comprises a plurality of jewels; and said string is passed through said jewels so that said jewels are arranged on the string.

3. The personal ornament according to claim 1, wherein:

said elastic body is an O-ring.

4. The personal ornament according to claim 1, wherein:

said elastic body is a tubular body.

5. The personal ornament according to claim 1, wherein:

said elastic body is packed into the interior of said second hole part in said base body.

6. The personal ornament according to claim 1, wherein:

said elastic body has a substantially O-ring shape.

7. A personal ornament comprising a jewel and a string, wherein:

the jewel includes a base body and an elastic body:

the base body includes a pearl layer surrounding matrix material and having a hole defined by the pearl layer and the matrix material, the hole comprising two first hole parts and a second hole part;

the first hole parts are provided at positions facing opposite each other over the second hole part, and each of the first hole parts extends from a surface of the pearl layer to an interior of the matrix material to open at the second hole part;

the second hole part is disposed only in the interior of the matrix material, and the second hole part has an internal diameter that is larger than internal diameters of the first hole parts;

the elastic body is constructed from an organic material and has a through-hole and is disposed in the interior of the second hole part, one open end of the through-hole communicating with an outside of the base body via one first hole part, another open end of the through-hole communicating with the outside of the base body via the other first hole part, and the internal diameter of the through-hole being gradually expanded toward each of the open ends; and the string is passed through the one first hole part, the through-hole, and the other first hole part, and the string is held in an elastic manner to permit sliding of the string relative to the elastic body.

8. The personal ornament according to claim 7, wherein:

the jewel comprises a plurality of jewels; and the string is passed through the jewels so that the jewels are arranged on the string.

9. The personal ornament according to claim 7, wherein:

the elastic body has a substantially O-ring shape.

10. A personal ornament comprising a jewel and a chain, wherein:

the jewel includes a base body and an elastic body:

the base body includes a pearl layer surrounding matrix material and having a hole defined by the pearl layer and the matrix material, the hole comprising two first hole parts and a second hole part;

the first hole parts are provided at positions facing opposite each other over the second hole part, and each of the first hole parts extends from a surface of the pearl layer to an interior of the matrix material to open at the second hole part;

the second hole part is disposed only in the interior of the matrix material, and the second hole part has an internal diameter defined by an inner surface of the matrix material that is larger than internal diameters of the first hole parts defined by the inner surface of the matrix material;

the elastic body is constructed from an organic material and has a through-hole and is disposed in the interior of the second hole part, one open end of the through-hole communicating with an outside of the base body via one first hole part, another open end of the through-hole communicating with the outside of the base body via the other first hole part, and the internal diameter of the through-hole being gradually expanded toward each of the open ends; and the chain is passed through the one first hole part, the through-hole, and the other first hole part, and the chain is held in an elastic manner to permit sliding of the chain relative to the elastic body.

11. The personal ornament according to claim 10, wherein:

the jewel comprises a plurality of jewels; and the chain is passed through the jewels so that the jewels are arranged on the chain.

12. The personal ornament according to claim 10, wherein:

the elastic body has a substantially O-ring shape.

13. A personal ornament comprising a jewel and a chain, wherein:

the jewel includes a base body and an elastic body:

the base body includes a pearl layer surrounding matrix material and having a hole defined by the pearl layer and the matrix material, the hole comprising two first hole parts and a second hole part;

the first hole parts are provided at positions facing opposite each other over the second hole part, and each of the first hole parts extends from a surface of the pearl layer to an interior of the matrix material to open at the second hole part;

the second hole part is disposed only in the interior of the matrix material, and the second hole part has an internal diameter that is larger than internal diameters of the first hole parts;

the elastic body is constructed from an organic material and has a through-hole and is disposed in the interior of the second hole part, one open end of the through-hole communicating with an outside of the base body via one first hole part, another open end of the through-hole communicating with the outside of the base body via the other first hole part, and the internal diameter of the through-hole being gradually expanded toward each of the open ends; and the chain is passed through the one first hole part, the through-hole, and the other first hole part, and the chain is held in an elastic manner to permit sliding of the chain relative to the elastic body.

14. The personal ornament according to claim 13, wherein:

the jewel comprises a plurality of jewels; and the chain is passed through the jewels so that the jewels are arranged on the chain.

15. The personal ornament according to claim 13, wherein:

the elastic body has a substantially O-ring shape.

* * * * *